US007993116B2

(12) United States Patent
Hoshina et al.

(10) Patent No.: US 7,993,116 B2
(45) Date of Patent: Aug. 9, 2011

(54) VARIABLE DISPLACEMENT VANE PUMP

(75) Inventors: Norikatsu Hoshina, Kanagawa (JP); Takao Muto, Tokyo (JP); Yukio Uchida, Kanagawa (JP); Jun Soeda, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 1055 days.

(21) Appl. No.: 11/802,127

(22) Filed: May 21, 2007

(65) Prior Publication Data

US 2008/0118372 A1 May 22, 2008

(30) Foreign Application Priority Data

Nov. 17, 2006 (JP) ..... 2006-311098

(51) Int. Cl.
*F03C 4/00* (2006.01)
*F04C 14/18* (2006.01)
*F04C 2/00* (2006.01)

(52) U.S. Cl. ..... 418/26; 418/27; 418/30; 417/220

(58) Field of Classification Search ..... 418/26–30; 417/220
See application file for complete search history.

(56) References Cited

U.S. PATENT DOCUMENTS 7,318,705 B2 1/2008 Uchino et al.
2005/0019174 A1* 1/2005 Uchino et al. ..... 417/220

FOREIGN PATENT DOCUMENTS

DE 10 2004 035 743 A1 2/2005
JP 2003-21076 1/2003

* cited by examiner

*Primary Examiner* — Theresa Trieu
(74) *Attorney, Agent, or Firm* — Foley & Lardner LLP

(57) ABSTRACT

A variable displacement vane pump includes a rotor, a cam ring; and a pump casing including first and second side walls disposed on both sides of the cam ring, and a circumferential wall surrounding the cam ring and defining first and second pressure chambers. A pressure introduction groove is formed in a sliding contact surface between the cam ring and one of the first and second side walls, and arranged so that a pressure lower than an outlet pressure is introduced.

18 Claims, 30 Drawing Sheets

VARIABLE DISPLACEMENT VANE PUMP

BACKGROUND OF THE INVENTION

The present invention relates to a variable displacement vane pump used as a pressure source for various devices.

A Japanese patent document JP 2003-021076A shows a variable displacement vane pump arranged to vary the volumes of pumping chambers by swing motion of a cam ring, and controlled to decrease a discharge quantity when the pump is driven at a high speed. In an inside abutting surface of a rear body, in a region between an inlet port and an outlet port, there is formed a recessed groove for introducing a high pressure, to alleviate a force pushing the cam ring toward the rear body and thereby to restrain internal leakage.

SUMMARY OF THE INVENTION

However, the above-mentioned vane pump encounters the following problems. (i) Because the outlet pressure is introduced, as the high pressure, into the recessed groove between the rear body and cam ring, the outlet pressure might leak to the low pressure side through the clearance between the rear body and cam ring, and thereby decrease the pump efficiency.

(ii) Moreover, since the opening area of the inlet port shaped like a crescent is very large, the rigidity of the housing is insufficient around the inlet port. If the rotor and drive shaft are deformed into a curved shape by the application of a differential pressure between the outlet and inlet pressures, the rear body and pressure plate receive influence of the curved deformation, and a radial inner side of the inlet port is deformed outwards in the axial direction of the drive shaft. Moreover, since a back pressure introducing groove is formed in the radial inner side of the inlet port, and arranged to receive a high pressure to project each vane from the rotor, this high pressure supplied to the back pressure introducing groove acts to further deform the radial inner side of the inlet port outwards in the axial direction of the drive shaft. Therefore, the radial outer side of the inlet port relatively projects inwards in the axial direction, and thereby pushes the swingable cam ring, causing localized wear.

It is therefore an object of the present invention to provide a variable displacement vane pump adapted to abate a force for pushing a cam ring to a pump casing such as a rear body and to restrain leakage through a clearance between the pump casing and cam ring to a lower pressure side. Another object is to provide a variable displacement vane pump adapted to restrain nonuniform wearing.

According to a first aspect of the present invention, a variable displacement vane pump comprises: a drive shaft; a rotor which is adapted to be driven by the drive shaft, which is formed with a plurality of slots and which is provided with a plurality of vanes each of which is slidably received in one of the slots; an annular cam ring receiving therein the rotor rotatably, the cam ring being arranged to swing about a swing axis, and to define a plurality of pumping chambers with the vanes between the rotor and the cam ring; a pressure control device; and a pump casing encasing the cam ring and the rotor, the pump casing including first and second side walls disposed on both sides of the cam ring so that the cam ring is located axially between the first and second side walls, an inlet port formed in at least one of the first and second side walls, an outlet port formed in at least one of the first and second side walls, and a circumferential wall surrounding the cam ring and defining first and second pressure chambers formed between the circumferential wall and the cam ring, one of the first and second pressure chambers being connected with the control valve so that a fluid pressure is controlled by the control valve. The pump casing further comprises a pressure introduction groove formed in a sliding contact surface between the cam ring and one of the first and second side walls.

According to a second aspect of the present invention, a variable displacement vane pump may comprise: (i) a drive shaft rotating on a center axis; (ii) a rotor which is mounted on the drive shaft so that the rotor is driven by the drive shaft, which is formed with a plurality of radial slots opening in an outer circumference of the rotor and which is provided with a plurality of vanes each of which is slidably received in one of the slots; (iii) an annular cam ring receiving therein the rotor rotatably, the cam ring being arranged to swing in a first direction, about a swing axis which extends along the center axis and which is spaced from the center axis in a second direction, and to define a plurality of pumping chambers with the vanes between the rotor and the cam ring; and (iv) a pump casing encasing the cam ring and the rotor. The pump casing may comprise (iv-a) a circumferential wall surrounding the cam ring, including an inside bore in which the cam ring is swingable on the swing axis, and defining first and second pressure chambers which are formed between the circumferential wall and the cam ring, and which are located, respectively, on first and second lateral sides opposing in the first direction across the center axis, so that a first fluid pressure in the first pressure chamber acts to cause the cam ring to swing toward the second lateral side in the first direction, and a second fluid pressure in the second pressure chamber acts to cause the cam ring to swing toward the first lateral side in the first direction; and (iv-b) first and second axial side walls disposed on both sides of the cam ring so that the cam ring is located axially between the first and second axial side walls. The pump casing further comprises (iv-c) an inlet port formed in at least one of the first and second side walls and arranged to let in an operating fluid into the pumping chambers; (iv-d) an outlet port formed in at least one of the first and second side walls and arranged to let out the operating fluid from the pumping chambers; and (iv-e) a pressure introduction groove formed in a sliding contact surface between the cam ring and one of the first and second side walls. The first direction may be a direction along a first imaginary axis (such as the y-axis) which is perpendicular to the center axis, and the second direction may be a direction along a second imaginary axis (such as the z-axis) perpendicular to the first imaginary axis (y-axis) and to the center axis of the drive shaft.

The variable displacement vane pump according to the above-mentioned first or second aspect may be further arranged so that the pump casing comprises the pressure introduction groove formed in the sliding contact surface between the cam ring and one of the first and second side walls, and arranged so that a pressure lower than an outlet pressure is introduced.

The variable displacement vane pump according to the first or second may be further arranged so that the pump casing further comprises first, second, third and fourth bolts extending along the drive shaft and joining a first body and a second body together to form a pump body. The first and second bolts are located on the side of the inlet port (on the upper side of the drive shaft, for example), and the third and fourth bolts are located on the side of the outlet port (on the lower side of the drive shaft, for example). The first, second, third and fourth bolts are so arranged that one of a first average distance L1 which is an average of an interaxis distance between the first and second bolts and an interaxis distance between the third and fourth bolts, and a second average distance L2 which is an average of an interaxis distance between the first and third bolts and an interaxis distance between the second and fourth bolts is shorter than the other. The pressure introduction groove is formed in a region defined by the drive shaft, and one of first and second pairs of the bolts defining a shorter one of the first and second average distances.

The variable displacement vane pump according to the first or second aspect may be further arranged so that the pressure introduction groove is formed in the sliding contact surface between the cam ring and one of the first and second plate members, on the side of the inlet port.

The variable displacement vane pump according to the first or second aspect may be further arranged so that the pressure introduction groove is a high pressure introducing groove formed on a radial outer side of the inlet port and arranged to receive a high pressure such as an outlet pressure of the vane pump. This variable displacement vane pump may further comprise a low pressure introducing groove formed in the sliding contact surface between the cam ring and one of the first and second side walls, and arranged so that a pressure lower than an outlet pressure is introduced.

DETAILED DESCRIPTION OF THE INVENTION

First Embodiment

FIGS. 1~6 are views for showing a variable displacement vane pump according to a first embodiment of the present invention.

[Outline of Variable Displacement Vane Pump]

Figure 1:
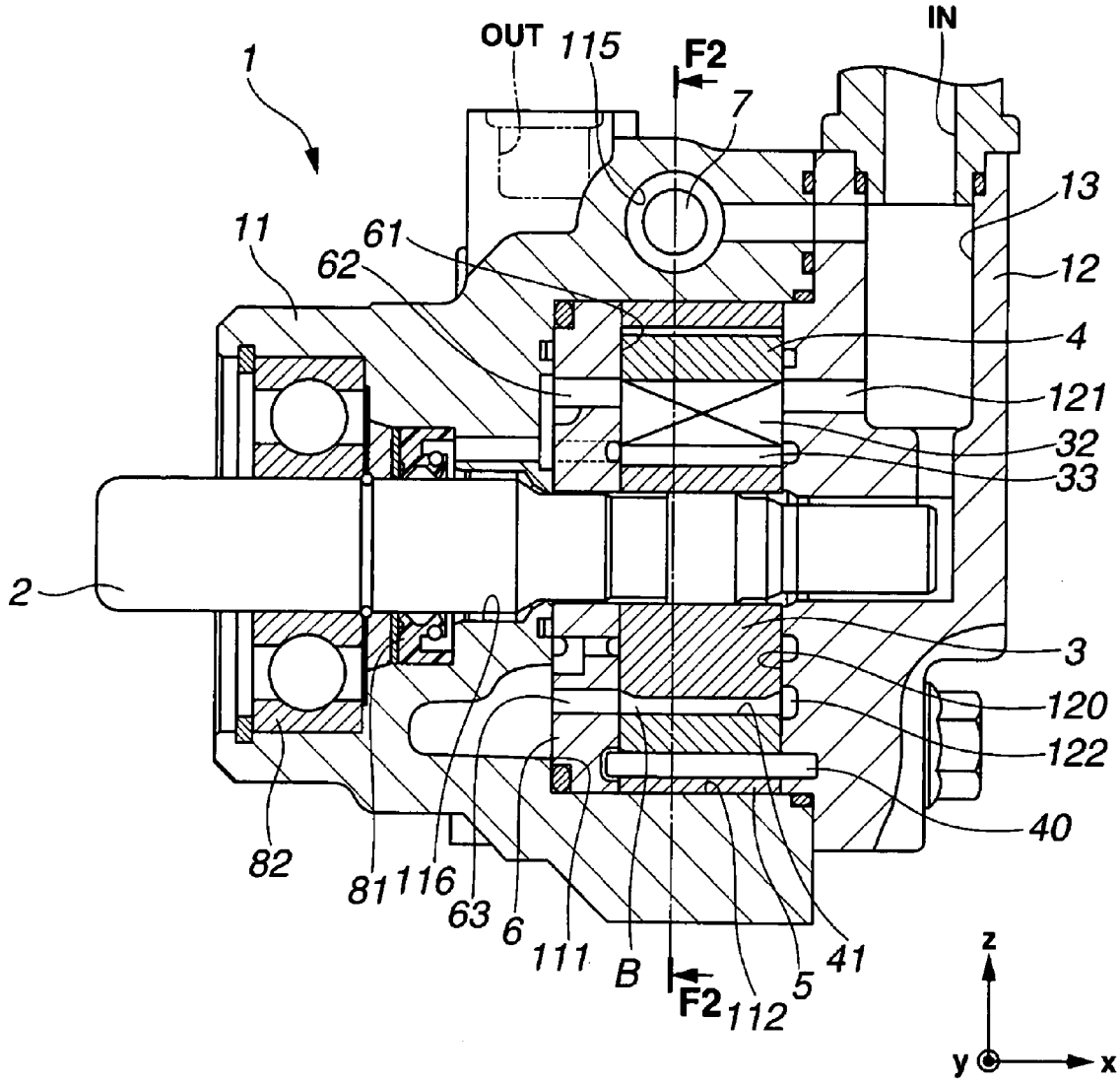
FIG. 1 is a longitudinal sectional view of a variable displacement vane pump according to a first embodiment of the present invention.
Figure 2:
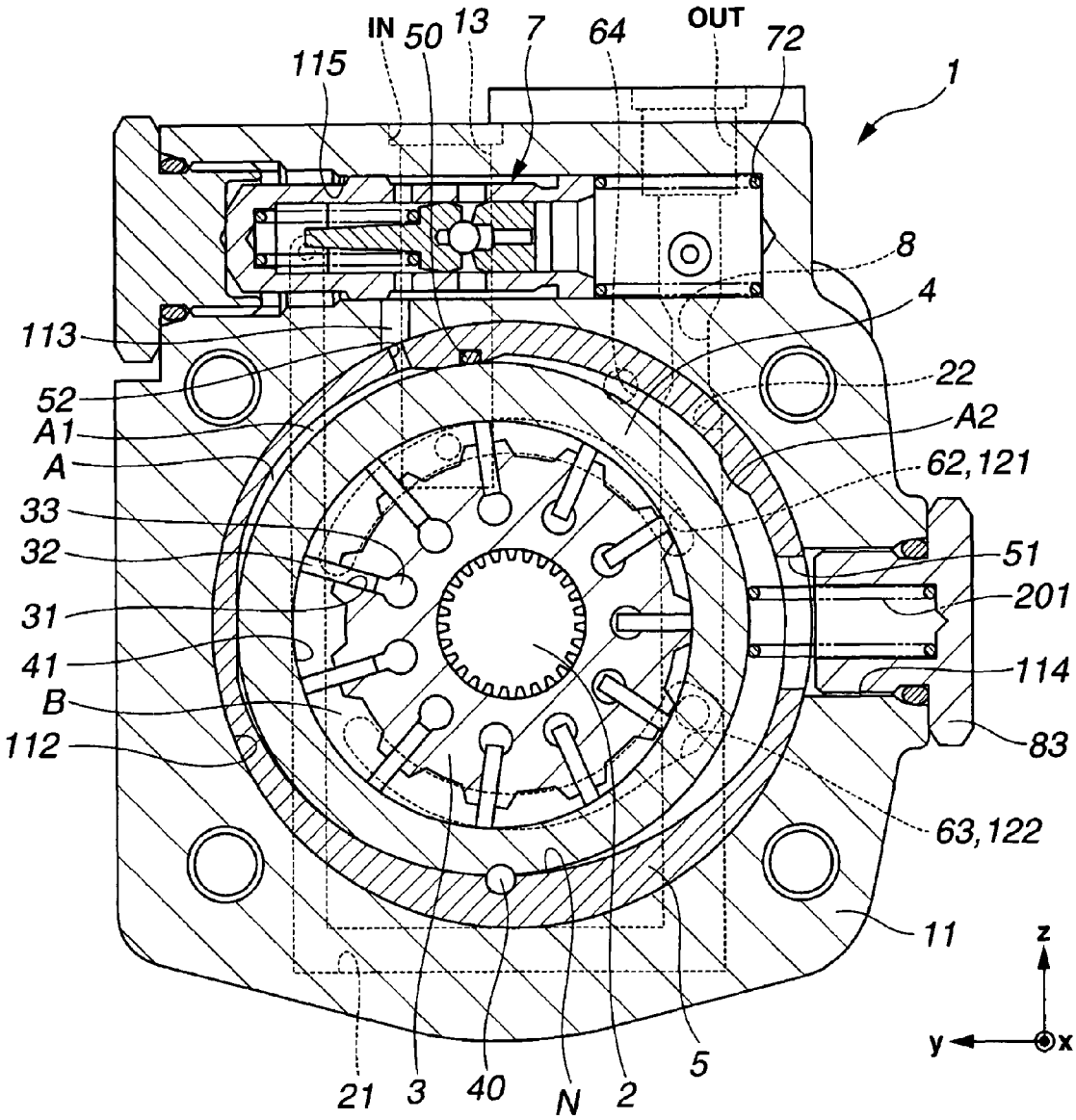
FIG. 2 is a cross sectional view taken across a line F2-F2 shown in FIG. 1.

FIG. 1 shows, in the form of an axial section, a variable displacement vane pump 1 according to the first embodiment of the present invention; and FIG. 2 is a section taken across a line F2-F2 shown in FIG. 1.

Variable displacement vane pump 1 includes a drive shaft 2, a rotor 3, a cam ring 4, an adapter ring 5, a pressure plate 6, and a pump body 10 composed of a front body 11 and a rear body 12. Rear body 12 can serve as a first plate, and pressure plate 6 can serve as a second plate.

Hereinafter, the axial direction of drive shaft 2 is set as an x-axis, and the direction in which drive shaft 2 is inserted from the rear body's side is defined as a negative direction. An axial direction of a spring 201 (shown in FIG. 2) for regulating the swing motion of cam ring 4 is set as a y-axis, and the direction in which spring 201 urges cam ring 4 is defined as a positive direction. The direction perpendicular to the x-axis and to the y-axis is set as a z-axis, and a positive direction is a direction toward an inlet IN.

Drive shaft 2 extends through a bearing 82, a seal member 81, a bearing portion 116 formed in front body 11, pressure plate 6 and rotor 3 in the order of mention along the x-axis from negative side to the positive side, and is supported by a bearing portion formed in rear body 12. Thus, drive shaft 2 extends along the x-axis from a first shaft end to a second shaft end supported by rear body 12. The first shaft end of drive shaft 2 on the x-axis negative side is adapted to be connected with a prime mover such as an engine, and to be driven by the prime mover.

Seal member 81 is disposed between bearing 82 and pressure plate 6, and drive shaft 2 passes through seal member 81. Seal member 81 liquid-tightly closes a pump element receiving portion 112 formed by an inside circumferential surface of front body 11 on the x-axis positive side (the right side as viewed in FIG. 1) of seal member 81.

A plurality of slots 31 in the form of axial grooves are formed radially in an outer circumference portion of rotor 3. In each slot 31, a vane 32 is inserted radially so that the vane 32 can move into and out of the slot 31. Each slot 31 has a back pressure chamber 33 formed at the radial inner end of the slot 31, and arranged to urge the corresponding vane 32 in the radial outward direction when an oil pressure is supplied to the back pressure chamber 33 (cf., FIG. 2).

Front body 11 and rear body 12 constitute pump body 10. Front body 11 is shaped like a cup having a bottom (111) and opening toward the x-axis positive side (rightwards in FIG. 1, toward rear body 12). Pressure plate 6 in the form of a circular disk is disposed on a bottom 111 in front body 11. Front body 11 includes a circumferential wall which surrounds, and thereby defines, the pump element receiving portion 112 in front body 11. Pump element receiving portion 112 contains adapter ring 5, cam ring 4 and rotor 3 on the x-axis positive side of pressure plate 6.

Rear body 12 abuts, liquid-tightly from the x-axis positive side (from the right side as viewed in FIG. 1), on the adapter ring 5, cam ring 4 and rotor 3. Thus, adapter ring 5, cam ring 4 and rotor 3 are sandwiched axially between pressure plate 6 and rear body 12, and surrounded by the circumferential wall of front body 11.

Rear body 12 includes a fluid (oil) passage 13 formed between first and second bolts B1 and B2. Fluid passage 13 extends along an imaginary line (in the z-axis direction) connecting a point located substantially at the middle, in the circumferential direction, of at least one of inlet ports (62, 121) and a point located substantially at the middle of at least one of outlet ports (63, 122) in the circumferential direction.

Inlet ports 62 and 121 and outlet ports 63 and 122 are opened, respectively, in a sliding contact surface 61 which is a side surface of pressure plate 6 on the x-axis positive side and which is in sliding contact with rotor 3, and a sliding contact surface 120 which is a side surface of rear body 12 on the x-axis negative side and which is in sliding contact with rotor 3. Inlet ports 62 and 121 are connected to an inlet opening IN. Outlet ports 63 and 122 are connected to an outlet opening OUT. Inlet and outlet ports 61, 121, 62 and 122 function to supply and drain the operating fluid (oil) to and from a pump chamber B formed between rotor 3 and cam ring 4 (cf., FIG. 2).

Adapter ring 5 (which can serve as a circumferential wall of the pump casing) is an annular member shaped like an ellipse having a major axis along the y-axis and a minor axis along the z-axis. Adapter ring 5 is surrounded by the circumferential wall of front body 11 on the radial outer side, and the adapter ring 5 surrounds cam ring 4 on the radial inner side.

Cam ring 4 is an annular member shaped like a circle and the outside diameter of cam ring 4 is substantially equal to the minor axis of adapter ring 5. Cam ring 4 is positioned by a positioning pin 40. The circular cam ring 4 is received in the elliptical inside bore of adapter ring 5, and there is formed, between the outer circumference of cam ring 4 and the inner circumference of adapter ring 5, a fluid pressure chamber A. Cam ring 4 can swing in the y-axis direction in adapter ring 5.

A (first) seal member 50 is provided in a z-axis positive direction end portion (upper end portion as viewed in FIG. 2) of an inner circumferential surface 53 of adapter ring 5. In a z-axis negative direction end portion (lower end portion as viewed in FIG. 2) of the inner circumferential surface 53 of adapter ring 5, there is formed a support surface N (confronting the seal member 50 diametrically. At this support surface N, adapter ring 5 holds or supports a z-axis negative direction end (or lower end) portion of cam ring 4. The above-mentioned positioning pin 40 is provided in the support surface N of adapter ring 5. By the positioning pin 40 and (first) seal member 50, the fluid pressure chamber A between cam ring 4 and adapter ring 5 is divided into a first fluid pressure chamber A1 on the y-axis negative side (the left side as viewed in FIG. 2) and a second fluid pressure chamber A2 on the y-axis positive side (the right side as viewed in FIG. 2) closer to spring 201.

Rotor 3 is received in cam ring 4 as shown in FIG. 2, and confined axially between the sliding contact surface 61 of pressure plate 6 and the sliding contact surface 120 of rear body 12 which are flat surfaces confronting axially each other as shown in FIG. 1. The outside diameter of rotor 3 is smaller than the inside diameter of the inside circumferential surface 41 of cam ring 4. Rotor 3 having the smaller outside diameter is thus received in cam ring 4 having the larger inside diameter. The rotor 3 is designed so that the outer circumference of rotor 3 does not abut on the inside circumferential surface 41 of cam ring 4 even if cam ring 4 swings, and the rotor 3 and cam ring 4 move relative to each other.

Figure 3A:
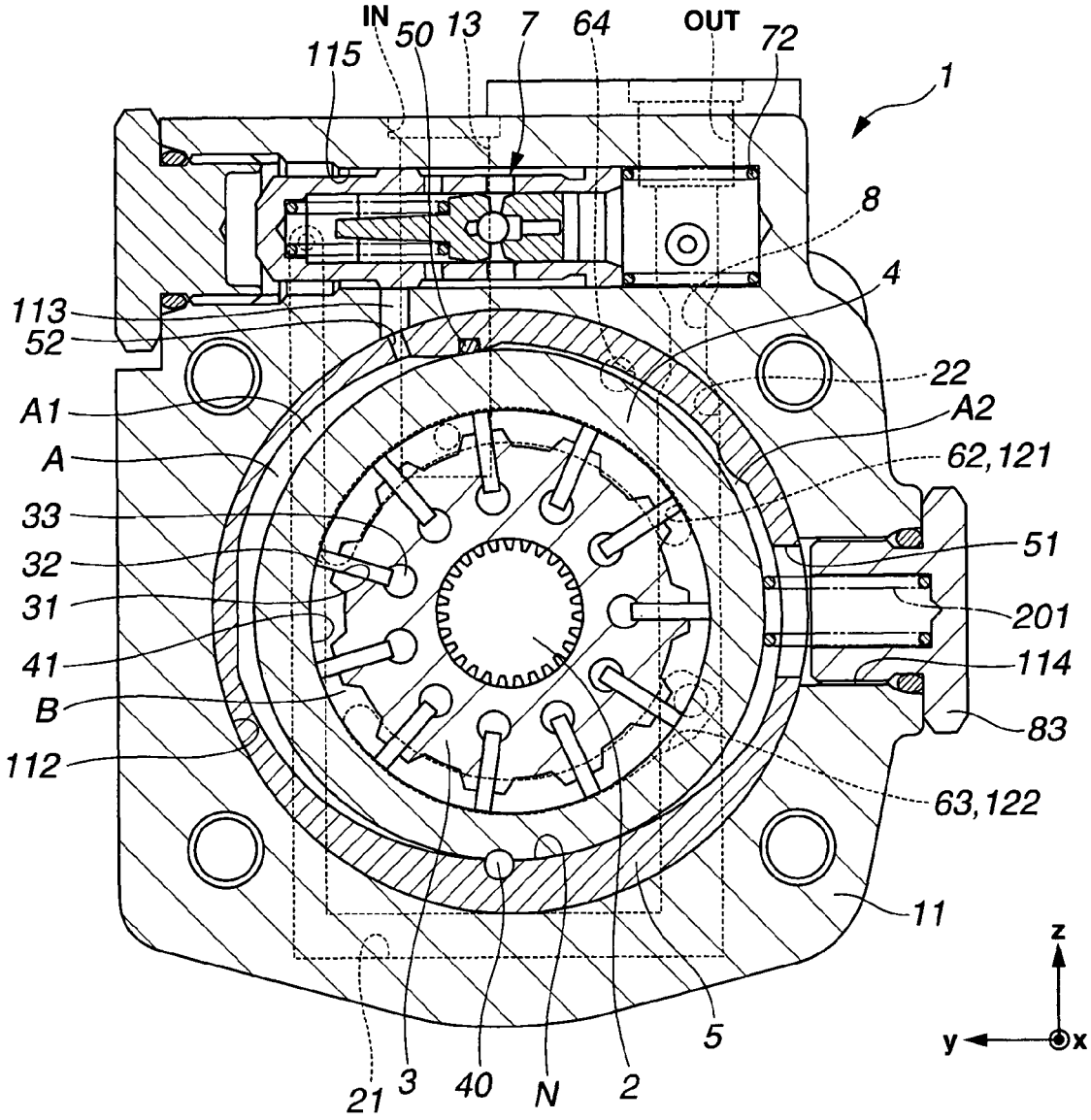
FIGS. 3A and 3B are views for illustrating swing motion or eccentricity of a cam ring relative to a rotor in the vane pump of FIG. 1.
Figure 3B:
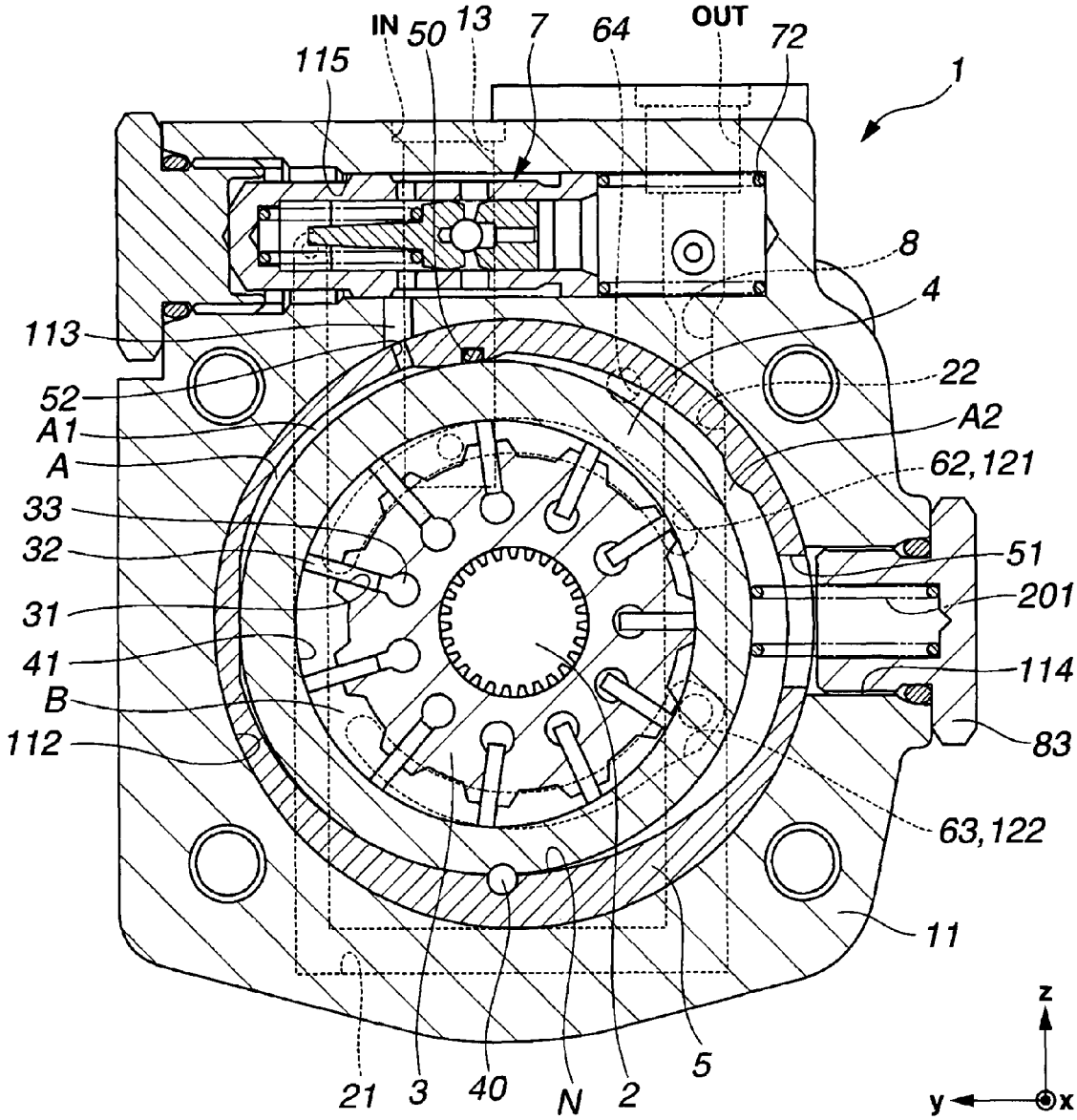

FIGS. 3A and 3B illustrate eccentric movement of cam ring 4 with respect to rotor 3. The eccentricity (eccentricity quantity) of cam ring 4 with respect to adapter ring 5 is smallest in the state shown in FIG. 3A, and the eccentricity is greatest in the state shown in FIG. 3B.

When cam ring 4 is at the position shown in FIG. 3A at which the cam ring 4 swings, to the maximum extent, to the y-axis negative side (the right side), the position of an axis (O1) of rotor 3 and the position of an axis (O2) of cam ring 4 substantially coincide with each other, so that the eccentricity is the smallest. In this state, the distance between the inside circumferential surface 41 of cam ring 4 and the outside circumferential surface of rotor 3 is substantially equal between the y-axis negative side and the y-axis positive side (between the left and right sides as viewed in FIG. 3A). When cam ring 4 swings, as shown in FIG. 3B, to the y-axis positive side (the left side), the axis (O1) of rotor 3 and the axis (O2) of cam ring 4 deviate from each other, and cam ring 4 is at an off-center or eccentric position with respect to rotor 3.

Vanes 32 are mounted on rotor 3 and arranged radially. The radial length of each vane 32 is greater than the maximum value of the distance between the inside circumferential surface 41 of cam ring 4 and the outside circumferential surface of rotor 3. Accordingly, irrespective of changes in the relative position between cam ring 4 and rotor 3, each vane 32 remains in the state in which a radial inner portion of the vane 32 is received in the corresponding slot 31 of rotor 3, and a radial outer portion of the vane 32 abuts on the inside circumferential surface 41 of cam ring 4. Each vane 32 always receives the back pressure in the corresponding back pressure chamber 33, and abuts on the inside circumference surface 41 of cam ring 4 liquid-tightly. Therefore, in the annular space between cam ring 4 and rotor 3, adjacent two of vanes 32 define a pumping chamber B always sealed liquid-tightly.

In the eccentric state (shown in FIG. 3B) in which cam ring 4 is swung to the y-axis negative side, the volume of each of the pumping chambers B each defined by adjacent two of vanes 32 varies in accordance with the rotation of rotor 3. By the volume variation of each pumping chamber B, the operating fluid is supplied or returned through the intake ports 62 and 121 and outlet ports 63 and 122 formed along the outer circumference of rotor 3 in the pressure plate 6 and rear body 12.

A radial through hole 51 is formed in a y-axis negative direction end portion of adapter ring 5. A plug insertion hole 114 is formed in a y-axis positive direction end portion of front body 11. A plug member 83 shaped like a cup having a bottom is inserted in the plug insertion hole 114 of front body 11, and arranged to seal the inside of vane pump 1 liquid-tightly with front body 11 and rear body 12.

The before-mentioned spring 201 is received in plug member 83 so that spring 201 can extend and compress in the y-axis direction. Spring 201 extends through radial through hole 51 of adapter ring 5, and abuts on cam ring 4. This spring 201 urges cam ring 4 in the y-axis positive direction toward the swing position at which the cam ring 4 is swung to the greatest extent to the positive side of the y-axis and the eccentricity is maximum, and thereby stabilizes the discharge quantity (the swing position of cam ring 4) in a pump starting operation in which the pressure is unstable. In this example, the opening of radial through hole 51 of adapter ring 5 is used as a stopper for limiting the swing motion of cam ring 4 in the y-axis negative direction. However, it is optional to use the plug member 83 as the stopper. In this case, plug member 83 for serving as the stopper extends through radial through hole 51 and projects into the radial inner side of adapter ring 5.

A pressure chamber communicating hole 52 is formed in a z-axis positive side portion (or upper portion) of adapter ring 5 at a position on the y-axis negative side of first seal member 50 (on the left side of seal member 50 as viewed in FIG. 2). This pressure chamber communicating hole 52 is connected, through a fluid (oil) passage 113 formed in front body 11, with a control valve 7. This pressure chamber communicating hole 52 connects the first pressure chamber A1 on the y-axis positive side (on the left side in FIG. 2), with control valve 7. Fluid passage 113 opens to a valve receiving bore 115 containing the control valve 7. In a pump driving operation, a control pressure Pv is introduced into first fluid pressure chamber A1. Control valve 7 serves as a pressure controlling means.

[Control Valve]

Figure 4:
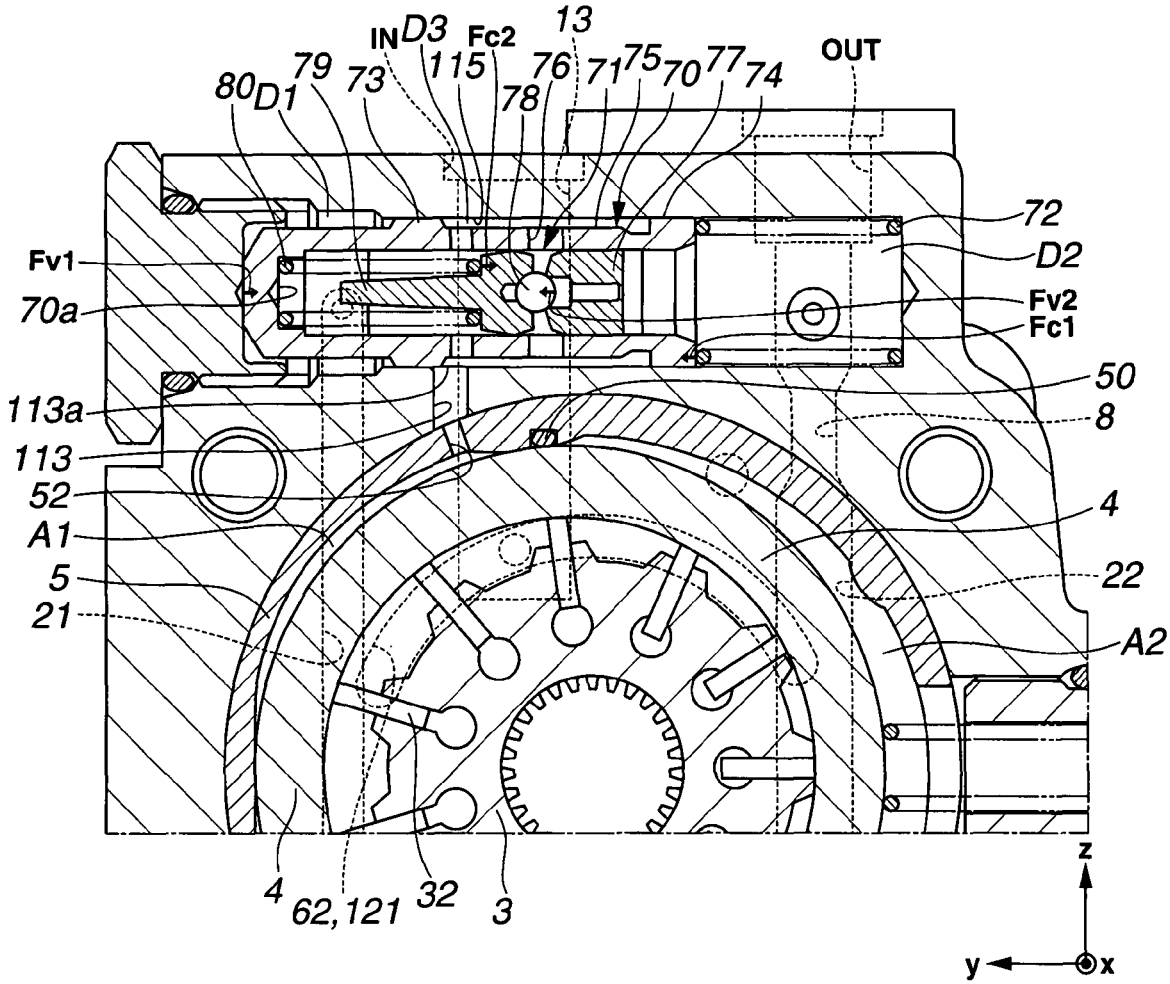
FIG. 4 is an enlarged view showing a control valve in the vane pump of FIG. 1.

FIG. 4 is an enlarged view showing control valve 7. Control valve 7 is a valve including a valve element 70 in the form of a spool. Control valve 7 is constituted by valve element 70 and a relieve valve 71. Valve element 70 is shaped like a cup having a bottom and opening in the y-axis negative direction. A biasing spring 72 urges valve element 70 in the y-axis positive direction. Relief valve 71 is received in valve element 70. Valve element 70 includes first and second sliding portions 73 and 74 formed in the outer circumference and so arranged that valve element 70 can slide liquid-tightly in the valve receiving bore 115 with the first and second sliding portions 73 and 74.

The first and second sliding portions 73 and 74 of valve element 70 are large diameter portions enlarged like an outward flange. Valve element 70 further includes a small diameter portion 75 formed axially (that is, in the y-axis direction) between first and second sliding portions 73 and 74 so that an annular depression is formed around the small diameter portion between first and second sliding portions 73 and 74. Thus, the valve receiving bore 115 is divide, by first and second sliding portions 73 and 74, into three fluid (oil) chambers D1, D2 and D3. The first fluid chamber D1 is formed on the y-axis positive side of first sliding portion 73; the second fluid chamber D2 is formed on the y-axis negative side of second sliding portion 74; and the third fluid chamber D3 is formed by the small diameter portion 75 between first and second sliding portion 73 and 74.

First fluid chamber D1 is connected through a fluid passage 21 with outlet ports 63 and 122. Second fluid chamber D2 is connected through a fluid passage 22 with outlet ports 63 and 122. An orifice 8 is provided in fluid passage 22. Therefore, an outlet pressure Pout is introduced into first fluid chamber D1. An orifice downstream pressure Pfb on the downstream side of orifice 8 is introduced into second fluid chamber D2. This orifice downstream pressure Pfb is lower than the outlet pressure Pout by a pressure decrease caused by orifice 8.

Third fluid chamber D3 is connected through a fluid passage 23 with the inlet opening IN, so that an inlet pressure Pin is introduced into third fluid chamber D3. Third fluid chamber D3 is further connected, through a radial hole 76 formed in the small diameter portion 75, with the inside cavity of valve element 70. In the inside cavity of valve element 70, there is disposed the relief valve 71 by which the second and third fluid chambers D2 and D3 are separated.

First fluid chamber passage 113 and a first fluid pressure chamber communicating hole 52 are formed, respectively, in front body 11 and adapter ring 5, at a position in the z-axis positive side (upper) portions of front body 11 and adapter ring 5, on the y-axis positive side of seal member 50. First fluid chamber passage 113 extends to an open end 113*a* opening in valve receiving bore 115. In the pump non-driving state, this open end 113*a* of first fluid chamber passage 113 confronts the small diameter portion 75 of valve element 70 at a position overlapping small diameter portion 75 in the y-axis direction, and thereby opens into third fluid chamber D3. When valve element 70 moves in the y-axis negative direction, and the first sliding portion 73 moves in the y-axis negative direction beyond the open end 113*a*, the first fluid passage 113 opens into first fluid chamber D1.

Valve element 70 receives a force Fv1 in the y-axis negative direction from first fluid chamber D1, a force Fv2 in the y-axis positive direction from second fluid chamber D2, and an urging force Fc1 of spring 72 in the y-axis positive direction. The balance condition is expressed as:

$$Fv1=Fv2+Fc1$$

Therefore, if $$Fv1>Fv2+Fc1 \quad \text{(a)},$$

then the open end 113*a* is located on the y-axis positive side of first sliding portion 73, and hence connected with first fluid chamber D1.

If, on the other hand, $$Fv1\leqq Fv2+Fc1 \quad \text{(b)},$$

then the valve element 70 moves in the y-axis positive direction, and the open end 113*a* is located on the y-axis negative side of first sliding portion 73. Thus, first fluid passage 113 is connected with third fluid chamber D3. By adjusting the urging or resilient force of the valve element urging spring 72, it is possible to adjust the communicating conditions of first fluid passage 113 with first or third fluid chamber D1 or D3.

[Relief Valve]

Relief valve 71 includes a valve seat 77, a ball valve element 78, a spring retaining portion 79 and a relief valve spring 80 which are arranged in this order from the y-axis negative direction. Valve seat 77 is slidably received in valve element 70 of control valve 7 so that valve seat 77 is slidable axially (in the y-axis direction) with respect to valve element 70. Valve seat 77 separates the second fluid chamber D2 and the inside cavity of valve element 70 liquid-tightly from each other.

Valve seat 77 is formed with an axial through hole 77*a* arranged to apply the force Fv2 due to the fluid pressure in second fluid chamber D2, onto the ball element 78.

Relief valve spring 80 has a y-axis positive direction end which is retained by a bottom 70*a* of valve element 70. Relief valve spring 80 urges ball element 78 in the y-axis negative direction through spring retaining portion 79. Therefore, ball element 78 receives the force Fv2 of the fluid pressure in second fluid chamber D2 from the y-axis negative side, and an urging force Fc2 of relief valve spring 80 from the y-axis positive side.

Therefore, if $$Fv2 \leqq Fc2 \quad (c),$$

then the ball element 78 closes the axial through hole 77*a* by abutting on valve seat 77, and thereby shuts off the second and third fluid chambers D2 and D3 from each other.

If, on the other hand, $$Fv2 > Fc2 \quad (d),$$

then the ball element 78 moves away from valve seat 77 and connects the second and third fluid chambers D2 and D3 with each other. Therefore, third fluid chamber D3 communicates with the inlet opening IN and second fluid chamber D2. Thus, by adjusting the urging force Fc2 of relief valve spring 80, it is possible to adjust the valve opening condition of relief valve 71.

[Communication between Control Valve and First Fluid Chamber]

(i) When first fluid chamber D1 and first fluid passage 113 are connected (the condition (a) is satisfied): In this case, the outlet pressure Pout (the pressure on the upstream side of orifice 8) is always introduced from first fluid chamber D1 into first fluid pressure chamber A1 through first fluid passage 113 and first fluid pressure chamber communication hole 52.

(ii) When third fluid chamber D3 and first fluid passage 113 are connected (the condition (b) is satisfied): In this case, in dependence on the open or close state of relief valve 71, the pressure of third fluid chamber D3 varies, and the pressure introduced into first fluid pressure chamber A1 differs.

(ii-i) When relief valve 71 is in the close or shut-off state (the condition (c) is satisfied): Second and third fluid chambers D2 and D3 are shut off from each other, and the inlet pressure Pin is introduced into first fluid pressure chamber A1 through fluid passage 23 and third fluid chamber D3.

(ii-ii) When relief valve 71 is in the open or communicating state (the condition (d) is satisfied): Third fluid chamber D3 is connected with fluid passage 23, and second fluid chamber D2. The pressure of third fluid chamber D3 is introduced, as a mixed pressure Pm of the inlet pressure Pin and the orifice downstream pressure Pfb of second fluid chamber D2 (outlet pressure Pout>Pm>inlet pressure Pin).

Thus, control valve 7 supplies, to first fluid pressure chamber A1, the control valve pressure Pv which is equal to the outlet pressure Pout (Pv=Pout) in the case of (i); the inlet pressure Pin (Pv=Pin) in the case of (ii-i); and the mixed pressure Pm (Pv=Pm) in the case of (ii-ii). Namely, control valve 7 receives outlet pressure Pout in first fluid chamber D1, the orifice downstream pressure Pfb in second fluid chamber D2, and the inlet pressure Pin in third fluid chamber D3; and controls the pressure P1 of first fluid pressure chamber A1 by producing control valve pressure Pv by using differential pressure among these three pressures Pout, Pfb and Pin.

Since control valve pressure Pv is restrained by the spring force Fc1 of valve element urging spring 72 and the spring force Fc2 of relief valve spring 80, it is possible to change the communicating conditions of first fluid passage 113 with first and third fluid chambers D1 and D3, and the valve opening condition of relief valve 71 by adjusting the spring forces Fc1 and Fc2 appropriately, and thereby to change the control valve pressure Pv.

[Construction of Pressure Introduction Groove(s)]

Figure 5:
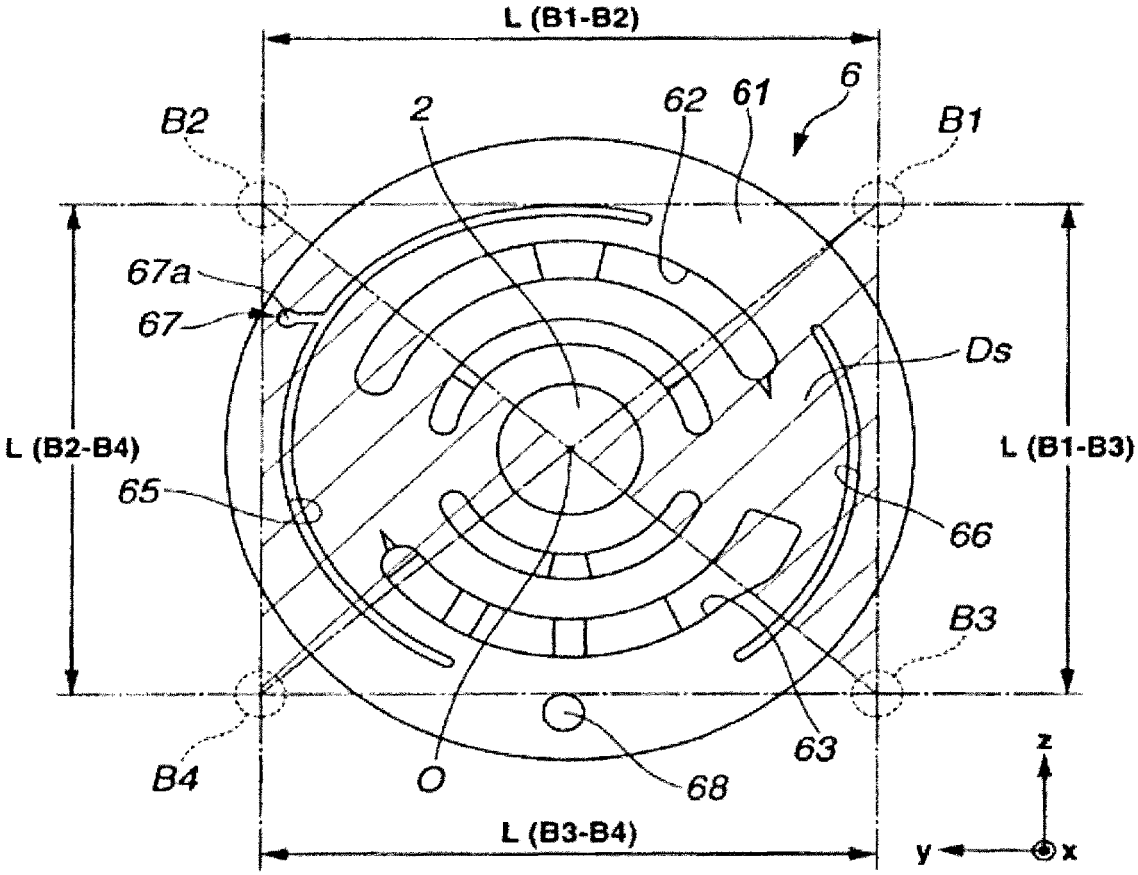
FIG. 5 is a view showing a sliding contact surface of a pressure plate of the vane pump of FIG. 1 according to the first embodiment.
Figure 6:
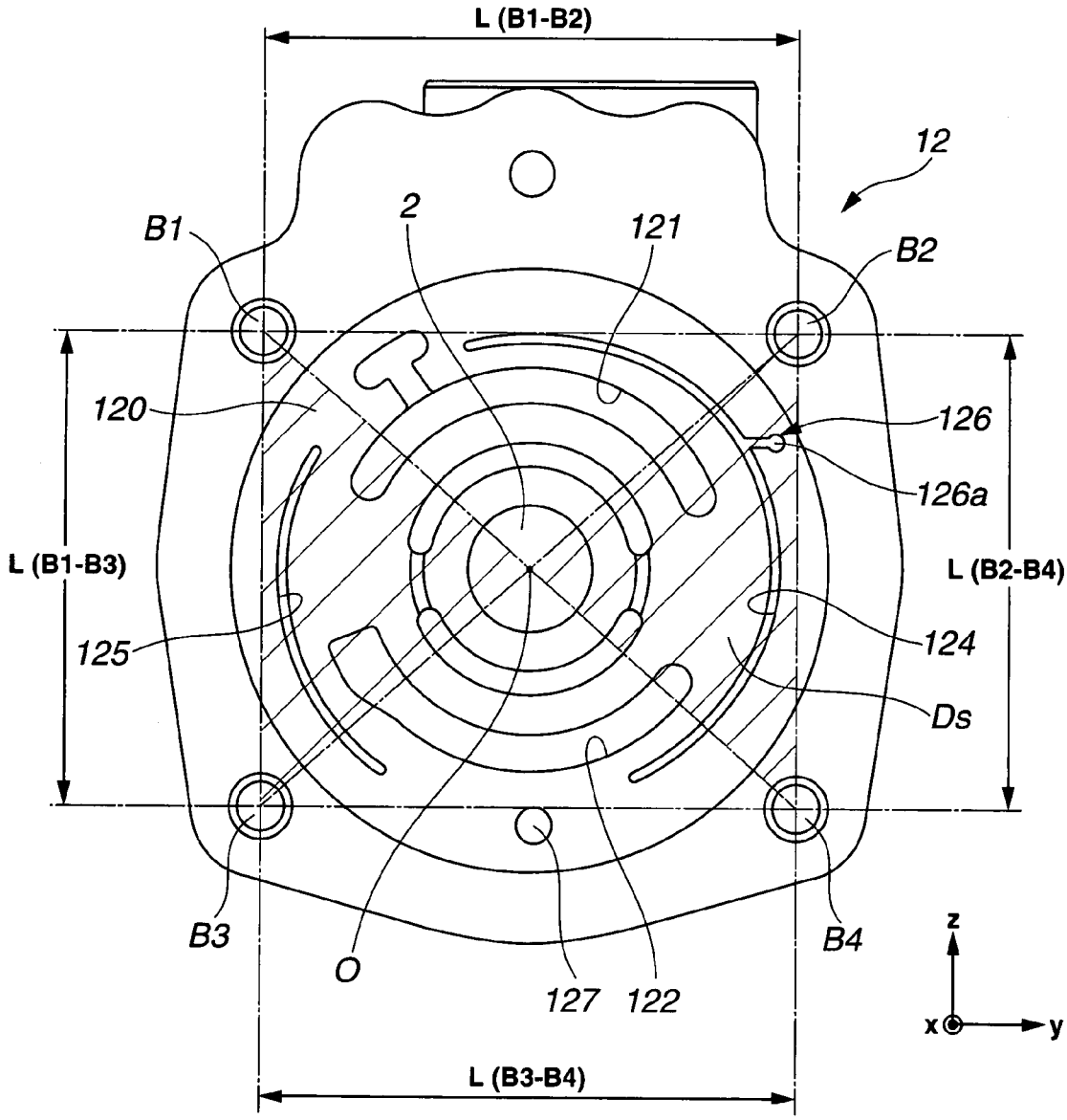
FIG. 6 is a view showing a sliding contact surface of a rear body of the vane pump of FIG. 1 according to the first embodiment.

FIG. 5 is a view of pressure plate 6 as viewed from the x-axis positive direction (from the right side as viewed in FIG. 1), showing the sliding contact surface 61 which is in sliding contact with rotor 3 and which faces in the x-axis positive direction (rightward direction as viewed in FIG. 1). FIG. 6 is a view of rear body 12 as viewed from the x-axis negative direction, showing the sliding contact surface 120 which is in sliding contact with rotor 3 and which faces in the x-axis negative direction (leftward direction as viewed in FIG. 1). In this example, the sliding contact surfaces 61 and 120 are substantially flat and parallel to each other, and the center axis of the vane pump is substantially perpendicular to these sliding contact surfaces 61 and 120. These sliding contact surfaces 61 and 120 confront each other in the axial direction of drive shaft 2.

As shown in FIG. 5, sliding contact surface 61 of pressure plate 6 is formed with a first pressure introduction groove 65 and a second pressure introduction groove 66 which are located on the radial outer side of inlet port 62 and outlet port 63 opened in this sliding contact surface 61. First pressure introduction groove 65 is formed at a position corresponding to first fluid pressure chamber A1. Second pressure introduction groove 66 is formed at a position corresponding to second fluid pressure chamber A2. Moreover, the sliding contact surface 61 is formed with a pin hole 68 receiving the positioning pin 40, at a position on the radial outer side of the middle of outlet port 63.

As shown in FIG. 6, sliding contact surface 120 of rear body 12 is formed with a first pressure introduction groove 124 and a second pressure introduction groove 125 which are located on the radial outer side of inlet port 121 and outlet port 122 opened in this sliding contact surface 120. First pressure introduction groove 124 is formed at a position corresponding to first fluid pressure chamber A1. Second pressure introduction groove 125 is formed at a position corresponding to second fluid pressure chamber A2. Moreover, the sliding contact surface 120 is formed with a pin hole 127 receiving the positioning pin 40, at a position on the radial outer side of the middle of outlet port 122.

First and second pressure introduction grooves 65 and 66 are formed in a sliding contact area in which pressure plate 6 and cam ring 4 are in sliding contact with each other in regions between outlet port 63 and inlet port 62. Similarly, first and second pressure introduction grooves 124 and 125 are formed in a sliding contact area in which rear body 12 and cam ring 4 are in sliding contact with each other in regions between outlet port 122 and inlet port 123. The first and second pressure introduction grooves 65, 124 and 66, 125 are so arranged that a fluid pressure lower than the outlet pressure Pout is introduced.

Each of first pressure introduction grooves 65 and 124 includes a branch groove 67 or 126 having a fluid (or oil) accumulating (or collecting) portion 67*a* or 126*a* formed on the radial outer side of the first pressure introduction groove 65 or 124. These branch grooves 67 and 126 are formed so that these branch grooves 67 and 126 are always located at the position corresponding to the first pressure chamber A1, and the control pressure Pv can be supplied to the first pressure introduction grooves 65 and 124 even in the swing state in which cam ring 4 is swung most in the y-axis positive direction to the greatest eccentricity. Furthermore, so as to introduce the control pressure Pv efficiently into first pressure introduction grooves 65 and 124, the fluid accumulating portions 67*a* and 126*a* having a circular cross section as shown in FIGS. 5 and 6 are formed, respectively, at the forward (radial outward) ends of branch grooves 67 and 126.

First pressure introduction grooves 65 and 124 communicate with first pressure chamber A1, and the control pressure Pv regulated by control valve 7 is supplied to first pressure introduction grooves 65 and 124. On the other hand, second pressure introduction grooves 66 and 125 communicate with second pressure chamber A2, and the inlet pressure Pin is supplied to second pressure introduction grooves 66 and 125. The control pressure introduced into first pressure introduction grooves 65 and 124 is equal to outlet pressure Pout when the outlet pressure is high and the above-mentioned condition (a) is satisfied. When the outlet pressure Pout is low and the above-mentioned condition (b) is satisfied, the control pressure Pv is equal to an intermediate pressure which is higher than inlet pressure Pin and which is lower than outlet pressure Pout.

First and second pressure introduction grooves 65 and 66 are formed integrally in pressure plate 6 simultaneously when pressure plate 6 is formed by sintering. First and second pressure introduction grooves 124 and 125 are formed integrally in rear body 12 simultaneously when rear body is formed by aluminum die casting.

First pressure chamber A1 is formed on the side on which the eccentricity of cam ring 4 is increased, and second pressure chamber A2 is formed on the side on which the eccentricity of cam ring 4 is decreased. On the side of second pressure chamber A2, in the region between outlet port 63 or 122 and inlet port 62 or 121, each of first pressure introduction grooves 65 and 124 is formed so as to overlap with the outlet port and inlet port in the radial direction and so as not to overlap with the outlet port and inlet port in the circumferential direction.

First pressure introduction grooves 65 and 124 can be formed on the side of drive shaft 2, and the pressurized oil can be introduced into the interfaces between the cam ring 4 and the rear body 12 and pressure plate 6 even in the state in which the eccentricity of cam ring 4 with respect to rotor 3 is great.

Front body 11 and rear body 12 are joined together by first, second, third and fourth bolts B1, B2, B3 and B4 extending along the x-axis. First and second bolts B1 and B2 are located on the side of inlet ports 62 and 121 (that is, on the upper side). Third and fourth bolts B3 and B4 are located on the side of outlet ports 63 and 122 (on the lower side). First and third bolts B1 and B3 are located on one of first and second lateral sides whereas second and fourth bolts B2 and B4 are located on the other of the first and second lateral sides which are opposite (left and right) sides opposing across drive shaft 2 along the y-axis.

In FIGS. 5 and 6, L(B1-B2) is an interaxis distance between (the axes of) first and second bolts B1 and B2 in each of the sliding contact surfaces 61 and 120 of pressure plate 6 and rear body 12, and L(B3-B4) is an interaxis distance between (the axes of) third and fourth bolts B3 and B4 in each of the sliding contact surfaces 61 and 120 of pressure plate 6 and rear body 12. A first average distance L1 is the average of L(B1-B2) and L(B3-B4).

Similarly, in FIGS. 5 and 6, L(B1-B3) is an interaxis distance between (the axes of) first and third bolts B1 and B3 in each of the sliding contact surfaces 61 and 120 of pressure plate 6 and rear body 12, and L(B2-B4) is an interaxis distance between (the axes of) second and fourth bolts B2 and B4 in each of the sliding contact surfaces 61 and 120 of pressure plate 6 and rear body 12. A second average distance L2 is the average of L(B1-B3) and L(B2-B4).

First and second pressure introduction grooves 65, 124 and 66, 125 are formed in a region surrounded by the center axis O of drive shaft 2, and the bolt pairs defining a smaller one of the first and second average distances L1 and L2. In this example, the interaxis distances L(B1-B2) and L(B3-B4) in the y-axis direction are longer than the interaxis distances L(B1-B3) and L(B2-B4) in the z-axis direction, and the first average distance L1 is longer than the second average distance L2 (L1>L2).

Therefore, in each of the sliding contact surfaces 61 and 120, first and second pressure introduction grooves 65 or 124 and 66 or 125 are formed in a region Ds (shown by hatching in FIGS. 5 and 6) composed of a first triangular region formed by connecting the center axis O of drive shaft 2, and the axes of first and third bolts B1 and B3 by straight line segments, and a second triangular region formed by connecting the center axis O of drive shaft 2, and the axes of second and fourth bolts B2 and B4 by straight line segments. In each of the sliding contact surfaces 61 and 120, first and second pressure introduction grooves 65 or 124 and 66 or 125 are formed between the outlet port 63 or 122 and the inlet port 62 or 121.

[Operations]

In the variable displacement pump 1, since part of cam ring 4 overlaps the inlet ports 62 and 121 and outlet ports 63 and 122, the cam ring 4 tends to be shifted along the y-axis. Specifically, because the pressure is low on the side of rear body 12 where inlet opening IN is formed, the cam ring 4 is pressed onto rear body 12, and there is formed, between cam ring 4 and pressure plate 6, a clearance which can incur leakage of the pressurized oil.

Therefore, the variable displacement pump of earlier technology is arranged to push the cam ring 4 toward pressure plate 6 by supplying the outlet pressure Pout into a pressure introduction recessed groove formed in the sliding contact surface between rear body 12 and cam ring 4.

However, the outlet pressure Pout supplied into the pressure introduction recessed groove might leak to the low pressure side (to the side of the inlet pressure Pin) through a clearance between rear body 12 and cam ring 4, and thereby decrease the pump efficiency.

Therefore, according to the first embodiment of the present invention, pressure plate 6 and rear body 12 are formed with first pressure introduction grooves 65 and 124 and second pressure introduction grooves 66 and 125, and the control valve pressure Pv is supplied to the first and second pressure introduction grooves.

Therefore, the pressure difference between the inlet pressure Pin and the control pressure Pv supplied to the first and second pressure introduction grooves 65, 124, 66 and 125 is small since the control pressure Pv is intermediate between outlet pressure Pout and inlet pressure Pin when outlet pressure Pout is low. With this smaller pressure difference, the groove structure according to this embodiment can restrain the leakage. Moreover, the first pressure introduction grooves 65 and 124 and second pressure introduction grooves 66 and 125 are separated from the outlet ports and arranged so that outlet pressure Pout is not supplied to the first and second pressure introduction grooves 65, 124, 66 and 125. Therefore, this groove structure can restrain leakage of the outlet pressure Pout, and improve the efficiency of the pump.

When outlet pressure Pout is high, the control pressure Pv is equal to outlet pressure Pout. When outlet pressure Pout is high, the discharge quantity is decreased by decreasing the eccentricity of cam ring 4. Therefore, the vane pump does not decrease the pump efficiency even if the leakage of outlet pressure Pout is not restrained. Moreover, the oil under pressure supplied to the grooves 65, 124, 66 and 125 can be used as a lubricant for the sliding contact surfaces between cam ring 4, and pressure plate 6 and rear body 12. Therefore, this structure can make the swing motion of cam ring 4 smooth, and improve the controllability of the flow rate. Moreover, the first pressure introduction grooves 65 and 124 are so arranged that the intermediate pressure lower than outlet pressure Pout and higher than inlet pressure Pin is introduced. Therefore, this structure can secure the sufficient force for pushing cam ring 4 toward pressure plate 6 and simultaneously prevent leakage by decreasing the pressure difference between the intermediate pressure and inlet pressure Pin.

In the first embodiment, the pressure (control pressure Pv) controlled by control valve 7 is supplied, as the intermediate pressure, to the first pressure introduction grooves 65 and 124. Therefore, this arrangement simplifies the construction of the vane pump without the need for adding a special mechanism for producing the intermediate pressure.

According to the first embodiment, each of the first pressure introduction grooves 65 and 124 formed in the confronting sliding contact surfaces 61 and 120 of pressure plate 6 or rear body 12 with cam ring 4 includes the curved main groove curved like a circular arc and confined in an imaginary outer annular zone surrounding an imaginary inner annular zone in which the inlet port 62 or 121 and outlet port 63 or 122 are confined. Each of the first pressure introduction grooves 65 and 124 further includes the branch groove 67 or 126 extending radially outwards from the curved main groove. Irrespective of the eccentric position of cam ring 4 with respect to the rotor, the branch grooves 67 and 126 are always held at the positions confronting the pressure chamber A. Therefore, the pressurized oil can be supplied securely into the grooves 65 and 124.

In the first embodiment, the first grooves 65 and 124 and second grooves 66 and 125 are formed simultaneously with pressure plate 6 and rear body 12, respectively. Therefore, there is no need for adding steps for producing these grooves, and the number of required production steps can be decreased.

In the first embodiment, the oil collecting portions 67*a* and 126*a* are formed, respectively, at the outer ends of branch grooves 67 and 126. Oil collecting portions 67*a* and 126*a* are effective for improving the efficiency of the supply of the pressurized oil into the first grooves 65 and 124.

In the first embodiment, the first and second grooves 65, 124, 66 and 125 are formed in the outer annular zone surrounding the inlet ports 62 and 121 and outlet ports 63 and 122. Therefore, the grooves can supply the pressurized oil almost over the entire circumference of cam ring 4. Therefore, this structure can lubricate the entire circumferences of the sliding contact surfaces between the cam ring 4 and the pressure plate 6 and rear body 12, and make smooth the motion of cam ring 4.

Effects of First Embodiment (1) First pressure introduction grooves 65 and 124 and second pressure introduction grooves 66 and 125 are formed, respectively, in pressure plate 6 and rear body 12, and arranged so that a fluid pressure lower than the outlet pressure Pout is introduced into each of the first and second grooves 65, 124, 66 and 125. This groove structure can restrain leakage by decrease the pressure difference between the inlet pressure Pin and the pressure supplied to these grooves. Furthermore, the grooves 65, 124, 66 and 125 are not supplied with outlet pressure Pout. Therefore, this groove structure can restrain leakage of outlet pressure Pout, and improve the pump efficiency. Moreover, the pressurized oil supplied to these grooves 65, 124, 66 and 125 can be used as lubricant for lubricating the sliding contact surfaces between the cam ring 4 and the pressure plate 6 and rear body 12. Therefore, this groove structure can make the swing motion of cam ring 4 smooth, and improve the controllability of the flow rate.

(2) The first pressure introduction grooves 65 and 124 are so arranged that the (control) pressure Pv lower than outlet pressure Pout and higher than inlet pressure Pin is introduced into each of these grooves. Therefore, this groove structure can secure the force for pushing cam ring 4 toward pressure plate 6 with the (control) pressure Pv, and simultaneously restrain leakage by decreasing the pressure difference between the (control) pressure Pv and inlet pressure Pin.

(3) The first and second grooves 65, 124, 66 and 125 are so arranged that the control pressure Pv controlled by control valve 7 is supplied to these grooves. This groove structure can simplify the construction of the vane pump without requiring an additional mechanism for producing an intermediate pressure (which is lower than outlet pressure Pout, or which is lower than outlet pressure Pout and higher than inlet pressure Pin).

(4) According to the first embodiment, the pressure introduction groove includes at least the first pressure introduction groove 65 or 124 which is formed in the confronting sliding contact surface of pressure plate 6 or rear body 12 with cam ring 4 and which includes the curved main groove curved like a circular arc and confined in an imaginary outer annular zone surrounding an inner region in which the inlet port 62 or 121 and outlet port 63 or 122 are confined. The first pressure introduction groove 65 or 124 further includes the branch groove 67 or 126 extending radially outwards from the curved main groove, and communicating with first pressure chamber A1 or second pressure chamber A2.

Therefore, irrespective of the eccentric position of cam ring 4 with respect to rotor 3, the first pressure introduction groove 65 or 124 is always held at the positions confronting the pressure chamber A1 or A2. Therefore, the pressurized oil can be supplied securely into the pressure introduction groove.

(5) In the first embodiment, the oil collecting portions 67*a* and 126*a* are formed, respectively, at the outer ends of branch grooves 67 and 126. This groove structure can improve the efficiency of the supply of the pressurized oil into the first grooves 65 and 124.

(6) In the first embodiment, the first and second grooves 65, 124, 66 and 125 are formed in the outer annular zone surrounding the inlet ports 62 and 121 and outlet ports 63 and 122. This groove structure can uniformize the deformation in the x-axis positive direction in the entire circumference of the sliding contact region D of pressure plate 6 or rear body 12, and thereby hold the sliding contact region D flat and perpendicular to the center axis. Therefore, this groove structure can reduce the nonuniform wearing by causing cam ring 4 to abut on rear body 12 uniformly over the entire circumference. Moreover, by introducing the outlet pressure to the sliding contact surfaces between cam ring 4 and rear body 12 or pressure plate 6, this groove structure can improve the lubrication and further reduce nonuniform wearing.

(7) First and second pressure introduction grooves 65, 124, 66 and 125 are formed in a surface of rear body 12 or pressure plate 6. This arrangement secures the above-mentioned effect (6) more reliably.

(8) First and second pressure introduction grooves 65, 124, 66 and 125 are formed simultaneously with rear body 12 or pressure plate 6. Therefore, the production method is simplified and the number of required production steps is decreased without the need for steps for forming these grooves.

(9) Each of first and second pressure introduction grooves 65, 124, 66 and 125 is curved like a circular arc corresponding to the shape of cam ring 4.

The higher pressure introduced into first and second pressure introduction grooves 65, 124, 66 and 125 acts to produce a reaction force to cam ring 4. Therefore, by shaping the first and second pressure introduction grooves 65, 124, 66 and 125 in conformity with the shape of cam ring 4, it is possible to restrain deformation of rear body 12 or pressure plate 6 (the size of a step between the radial inner side and radial outer side of the inlet port 62 or 121).

(10) First pressure introduction grooves 65, 124 are in the form of the circular arc conforming to the shape of the cam ring in the state in which the eccentricity is greatest. Therefore, the groove structure can restrain the deformation of rear body 12 or pressure plate 6 securely in the state of the greatest eccentricity.

(11) First and second pressure introduction grooves 65, 124, 66 and 125 are formed in an outer annular zone surrounding an inner annular zone in which inlet and outlet ports 62, 121, 63 and 122 are formed. This groove structure can supply the pressurized oil over the entire circumference of cam ring 4, lubricate the entire circumference of each sliding contact surface between the cam ring 4 and the rear body 12 or pressure plate 6, and thereby make the sliding motion of cam ring 4 smooth.

(12) First pressure chamber A1 is formed on the side on which the eccentricity of cam ring 4 is increased; and second pressure chamber A2 is formed on the side on which the eccentricity of cam ring 4 is decreased. In a region between outlet port 63 or 122 and inlet port 62 or 121 on the side of second pressure chamber A2, each first pressure introduction groove 65 or 124 is formed so as to overlap the outlet port and the inlet port in the radial direction and so as not to overlap the outlet port and the inlet port in the circumferential direction.

Therefore, it is possible to form the first pressure introduction grooves 65 and 124 on the side of drive shaft 2 (or closer to drive shaft 2), and thereby to introduce the pressurized oil to the clearance between the cam ring 4 and the rear body 12 or pressure plate 6 even when the eccentricity is great.

(13) Each first pressure introduction groove 65 or 124 is formed in the following region. Front body 11 and rear body 12 are joined together by first and second bolts B1 and B2 provided on the side of inlet port 62 or 121. Inlet port 62 or 121 is formed on the z-axis positive (upper) side of drive shaft 2, and first and second bolts B1 and B2 are located on the same z-axis positive (upper) side of drive shaft 2. Front body 11 and rear body 12 are further joined together by third and fourth bolts B3 and B4 provided on the side of outlet port 63 or 122. Outlet port 63 or 122 is formed on the z-axis negative (lower) side of drive shaft 2, and third and fourth bolts B3 and B4 are located on the same z-axis negative (lower) side of drive shaft 2. The first, second, third and fourth bolts B1-B4 are arranged so that one of the first average distance which is the average of the interaxis distance between the first and second bolts and an interaxis distance between the third and fourth bolts, and the second average distance which is the average of the interaxis distance between the first and third bolts and the interaxis distance between the second and fourth bolts is shorter than the other of the first and second average distances. Each of the first pressure introduction groove 65 and 124 is formed in a region defined by the center axis of drive shaft 2, and one of first and second pairs of the bolts defining a shorter one of the first and second average distances so that the average distance of the interaxis distance between the two bolts of the first pair and the interaxis distance between the two bolts of the second pair is the shorter one of the first and second average distances which is shorter than the other.

(14) The first average distance L1 is greater then the second average distance L2; and the first pressure introduction grooves 65 and 121 are formed between outlet port 63 or 122 and inlet port 62 or 121.

(15) Rear body 12 is formed with fluid passage 13 extending along an imaginary line connecting a point substantially at a circumferential middle of the inlet port 62 or 121 and a point substantially at a circumferential middle of the outlet port 63 or 122, in a region between the first and second bolts B1 and B2; and first pressure introduction groove 65 or 124 is formed between the outlet port and the inlet port.

(16) In the sliding contact surface between the cam ring 4 and the rear body 12 or pressure plate 6, there is provided first pressure introduction groove 65 or 124 formed on the side of the inlet port 62 or 121.

(17) First pressure introduction groove 65 or 124 is arranged to receive a pressure lower than the outlet pressure.

Second Embodiment

Figure 7:
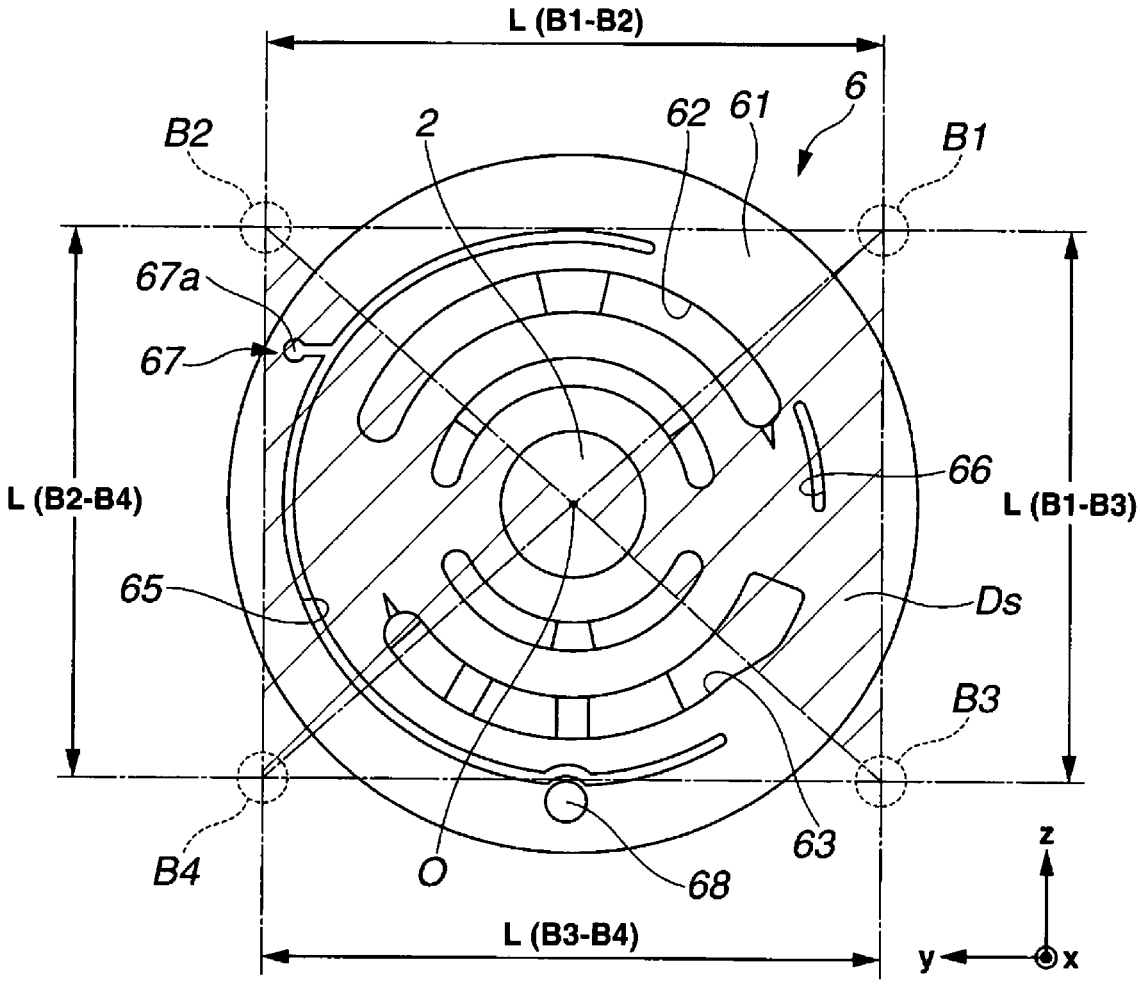
FIG. 7 is a view showing the sliding contact surface of the pressure plate according to a second embodiment of the present invention.
Figure 8:
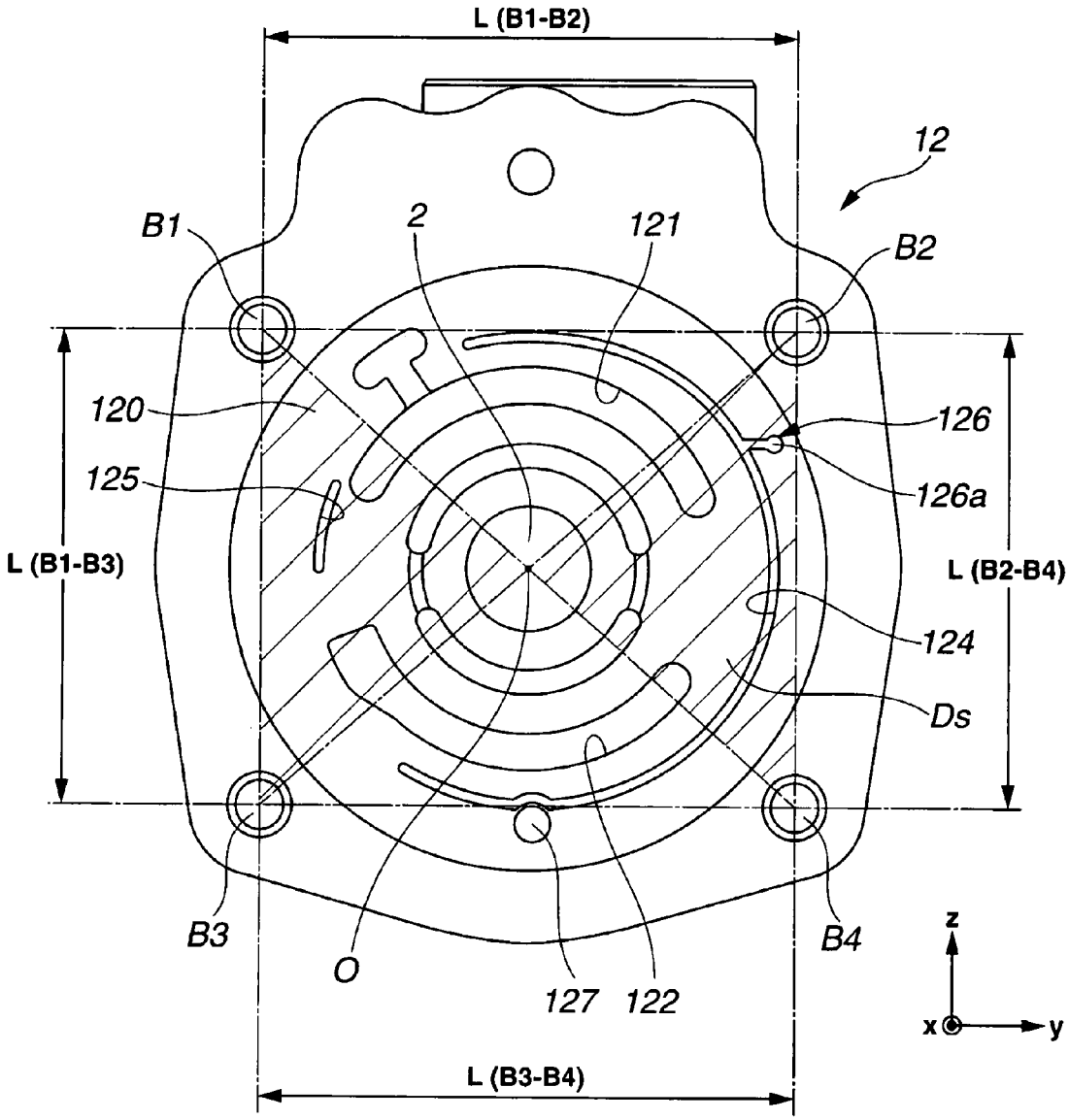
FIG. 8 is a view showing the sliding contact surface of the rear body according to the second embodiment.

FIGS. 7 and 8 show a variable displacement vane pump 1 according to a second embodiment of the present invention. The basic construction is the same as that of the first embodiment. Accordingly, the same reference numerals are given to the corresponding parts and repetitive explanation is omitted. FIG. 7 is a view of pressure plate 6 as viewed from the x-axis positive direction, for showing the sliding contact surface for contacting with rotor 3. FIG. 8 is a view of rear body 12 as viewed from the x-axis negative direction, for showing the sliding contact surface for contacting with rotor 3.

In the second embodiment, each of the first pressure introduction grooves 65 and 124 is extended circumferentially as compared to the first embodiment, whereas each of the second pressure introduction grooves 66 and 125 is made shorter in the circumferential length.

Each of the first pressure introduction grooves 65 and 124 extends circumferentially from an outlet port's side end located on the radial outer side of the outlet port 63 or 122 to an inlet port's side end on the radial outer side of the inlet port 62 or 121. The inlet port's side end of each of first grooves 65 and 124 is located on the y-axis negative side of the middle of the inlet port 62 or 121. The outlet port's side end of each of first grooves 65 and 124 is located on the y-axis negative side of the middle of the outlet port 63 or 122. On the radial outer side of the outlet port 63 or 122, each of first grooves 65 and 124 extends between the outlet port 63 or 122 and the pin hole 68 or 126 receiving the pin 40. Accordingly, the angle subtended at the center (O) by each of first grooves 65 and 124 shaped like a circular arc is a reflex angle greater than 180° and less than 360°.

Each of the second pressure introduction grooves 66 and 125 extends circumferentially from an outlet port's side end to an inlet port's side end. Each second groove 66 or 125 does not extend circumferentially beyond the y-axis negative side end of the inlet port 62 or 121, toward the middle of the inlet port 62 or 121, and hence does not overlap the inlet port 62 or 121 in the circumferential direction. Furthermore, the outlet port's side end of each second groove 66 or 125 is separated circumferentially from the y-axis negative side end of the outlet port 63 or 122, so that there is no overlap between the second groove 66 or 125 and the outlet port 63 or 122 in the circumferential direction. Namely, in each of pressure plate 6 and rear body 12, the second pressure introduction groove 66 or 125 is confined in a sector defined by a circular arc between the y-axis negative side ends of the inlet port 62 or 121 and the outlet port 63 and 122, and the second pressure introduction groove 66 or 125 extends neither into the sector defined by the arc-shaped inlet port 62 or 121 nor into the sector defined by the arc-shaped outlet port 63 or 122. In this groove arrangement, it is possible to form the second pressure introduction grooves 66 and 125 at a radial position closer to drive shaft 2.

[Operation]

In the second embodiment, each of first pressure introduction grooves 65 and 124 is formed, on the side of outlet port 63 or 122, between the outlet port 63 or 122 and the pin hole 68 or 127 for supporting the positioning pin 40. The first pressure introduction groove 65 or 124 can be arranged so that first pressure introduction groove 65 or 124 is separated from the pin hole 68 or 127 with no overlap, so that it is possible to prevent pressure leakage from the first pressure introduction grooves 65 and 124.

In the second embodiment, each second pressure introduction groove 66 or 125 formed on the side of second pressure chamber A2 terminates at the inlet port's side end with respect to the y-axis negative side end of the inlet port so as not to overlap the inlet port 62 or 121 in the circumferential direction. Therefore, it is possible to form the second pressure introduction grooves 66 and 125 at a radial position closer to drive shaft 2, and thereby to supply the pressurized oil to the clearance between the cam ring 4 and the rear body 12 or pressure plate even in the state of greater eccentricity.

Positioning pin 40 is supported by pin holes 68 and 127 formed on the radial outer side of outlet ports 63 and 122 in rear body 12 and pressure plate 6, and arranged to prevent relative rotation of cam ring 4 relative to the rear body 12 and pressure plate 6. First pressure introduction grooves 65 and 124 are formed between the outlet ports 63 an 122 and the pin holes 68 and 127. The first pressure introduction groove 65 or 124 can be arranged so that first pressure introduction groove 65 or 124 is separated from the pin hole 68 or 127 with no overlap, so that it is possible to prevent pressure leakage from the first pressure introduction grooves 65 and 124.

Third Embodiment

Figure 9:
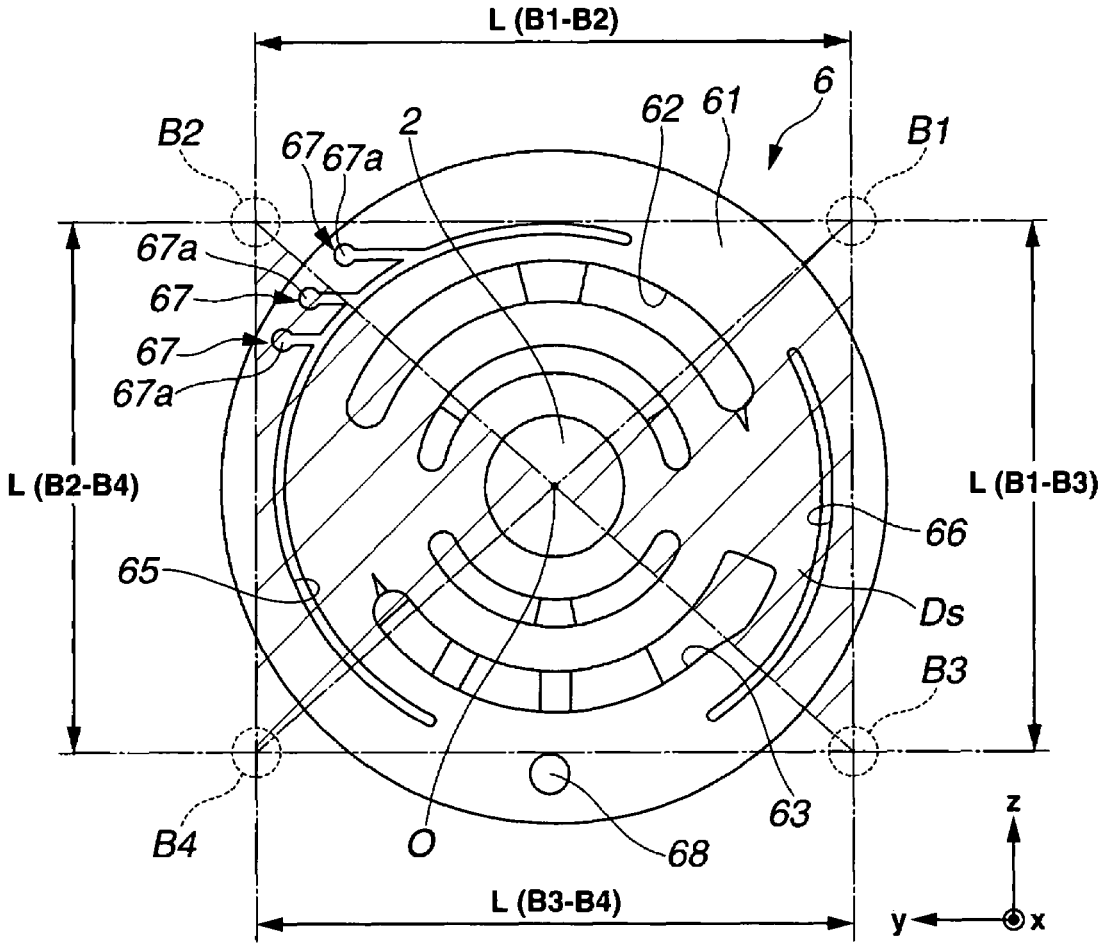
FIG. 9 is a view showing the sliding contact surface of the pressure plate according to a third embodiment of the present invention.
Figure 10:
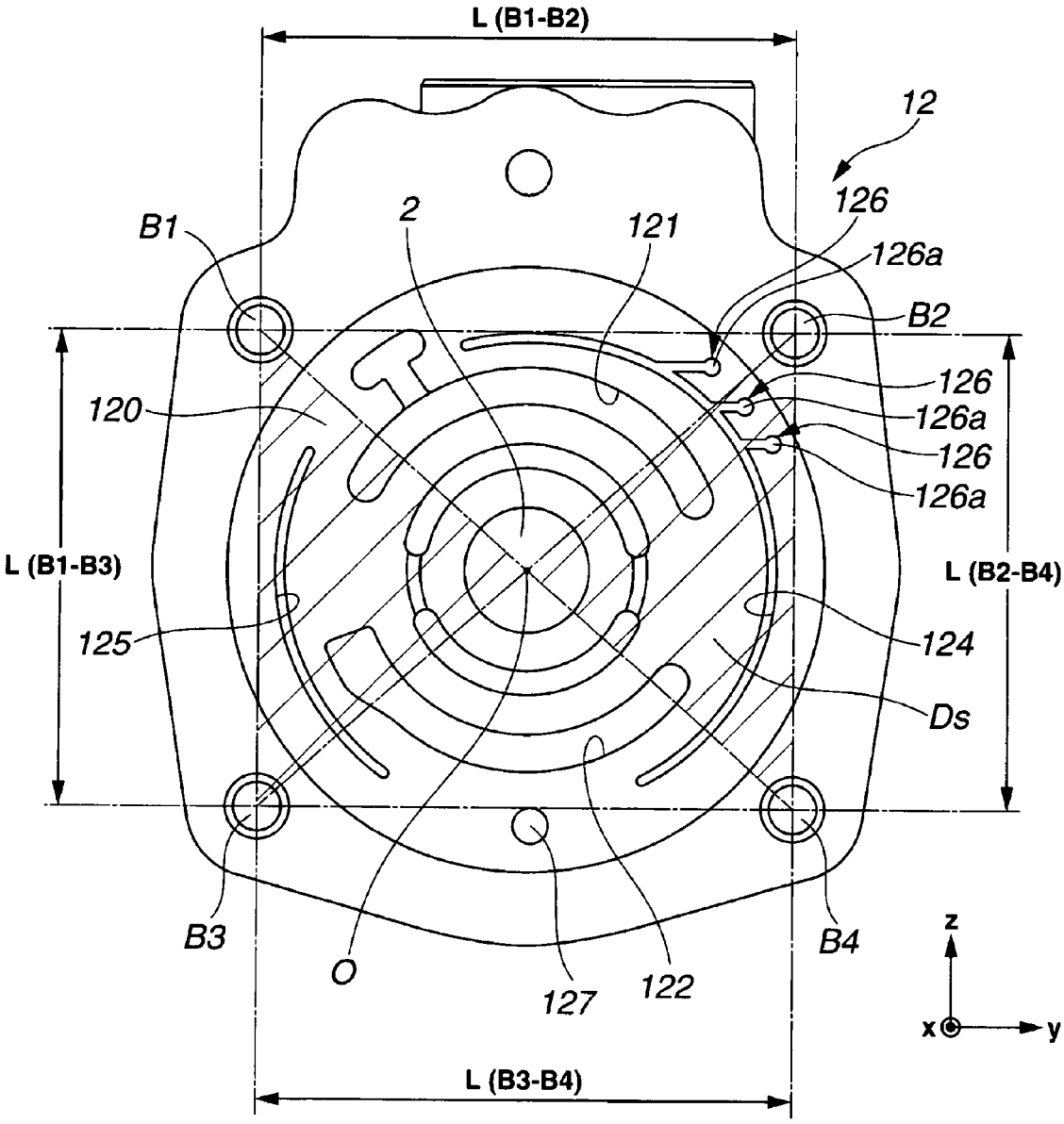
FIG. 10 is a view showing the sliding contact surface of the rear body according to the third embodiment.

FIGS. 9 and 10 show a variable displacement vane pump 1 according to a third embodiment of the present invention. The basic construction is the same as that of the first embodiment. Accordingly, the same reference numerals are given to the corresponding parts and repetitive explanation is omitted. FIG. 9 is a view of pressure plate 6 as viewed from the x-axis positive direction, for showing the sliding contact surface for contacting with rotor 3. FIG. 10 is a view of rear body 12 as viewed from the x-axis negative direction, for showing the sliding contact surface for contacting with rotor 3.

In the third embodiment unlike the first and second embodiments, each of the first pressure introduction groove 65 and 124 includes a plurality of branch grooves 67 or 126. Each of the branch grooves 67 or 126 includes a fluid (or oil) accumulating (or collecting) portion 67*a* or 126*a* formed on the radial outer side of the first pressure introduction groove 65 or 124. Each of the first pressure introduction groove 65 and 124 includes a main arc groove curved like a circular arc in conformity with the cross sectional shape of cam ring 4, and each branch groove 67 or 126 extends radially outwards from the main arc groove.

[Operation]

Each first pressure introduction groove 65 or 124 extends like a circular arc along the cross sectional shape of cam ring 4 and includes a plurality of branch grooves 67 or 126 extending radially outwards. This groove structure can expand the range of the pressure supply and supply the pressurized oil to the sliding contact surfaces securely, irrespective of the eccentric position of cam ring 4 with respect to rotor 3. The plural branch grooves 67 and 126 can supply the pressurized oil more reliably to the pressure introduction grooves, and provide the above-mentioned effect (4) more securely.

The following are variations of the first, second and third embodiments.

[Variation 1]

Figure 11:
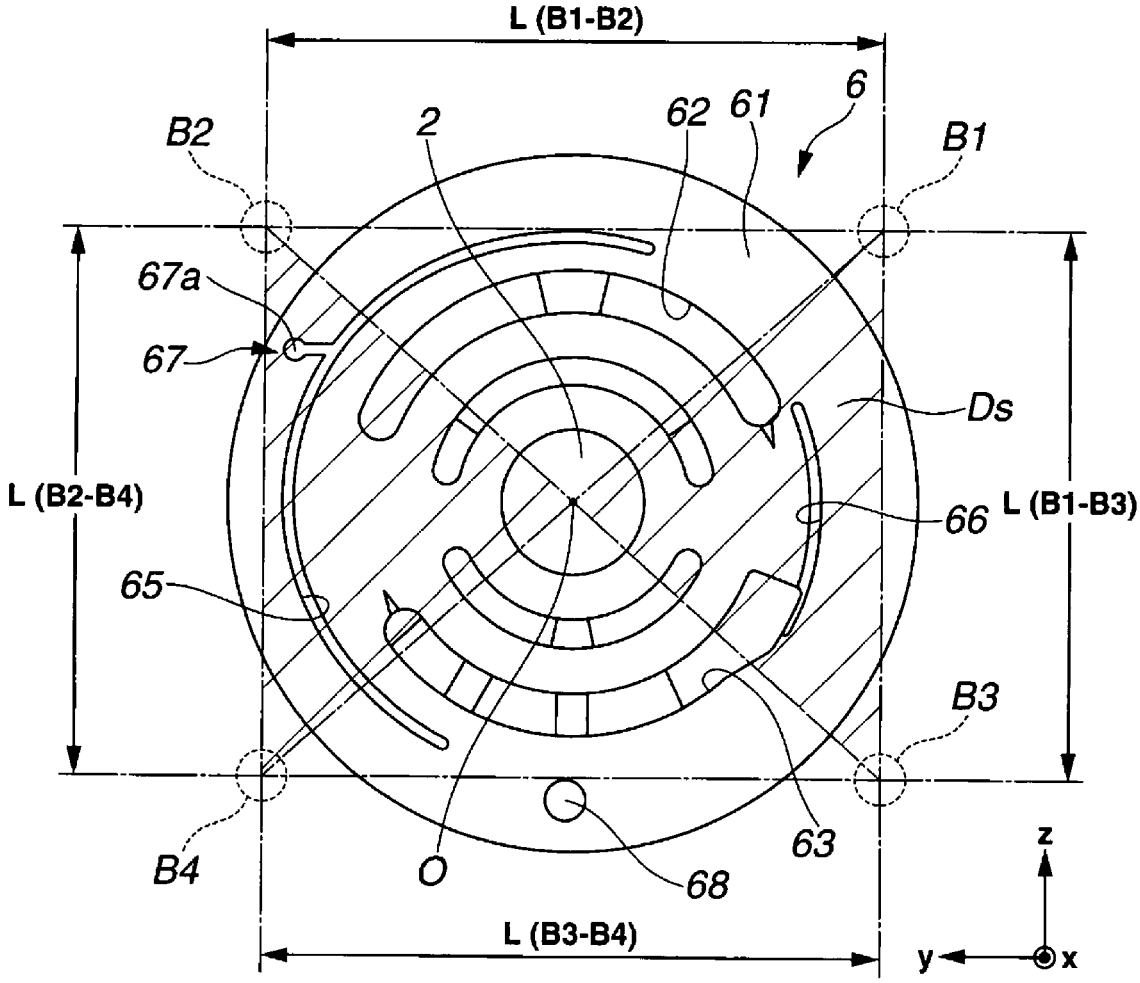
FIG. 11 is a view showing the sliding contact surface of the pressure plate according to a first variation.
Figure 12:
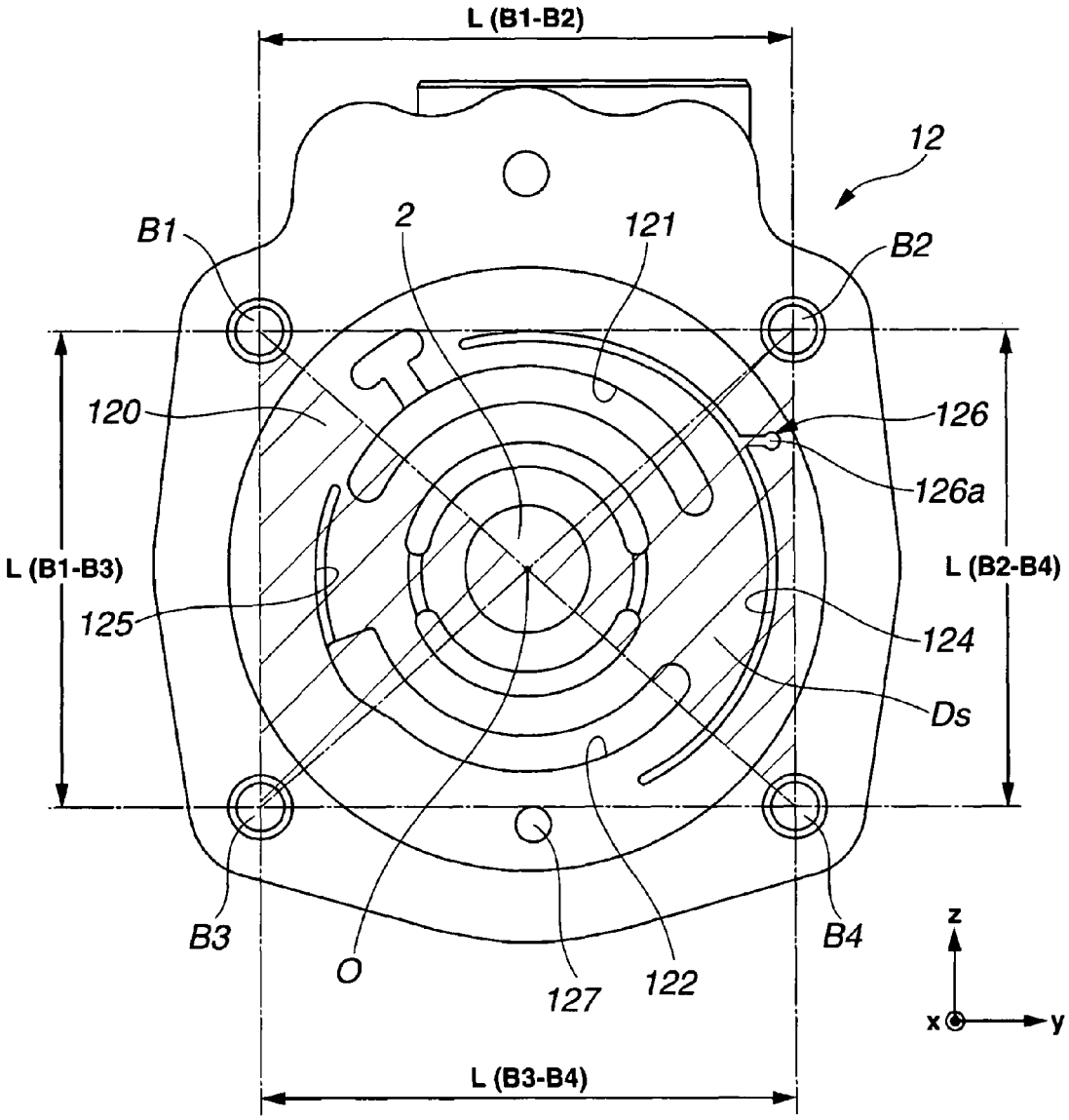
FIG. 12 is a view showing the sliding contact surface of the rear body according to the first variation.

FIG. 11 is a view of pressure plate 6 as viewed from the x-axis positive direction, for showing the sliding contact surface for contacting with rotor 3. FIG. 12 is a view of rear body 12 as viewed from the x-axis negative direction, for showing the sliding contact surface for contacting with rotor 3.

In the variation 1 shown in FIGS. 11 and 12, second pressure introduction grooves 66 and 125 are connected with outlet ports 63 and 122, respectively, and arranged to receive the outlet pressure Pout as high pressure. Each of second pressure introduction grooves 66 and 125 extends circumferentially from the outlet port 63 or 122, and terminates at the inlet port's side end, without extending beyond the y-axis negative side end of the inlet port 62 or 121. Therefore, there is formed no overlap with the inlet port in the circumferential direction.

Thus, second pressure introduction grooves 66 and 125 receiving outlet pressure Pout as high pressure are separated from inlet ports 62 and 121 receiving the lower inlet pressure. This groove structure can restrain leakage of outlet pressure Pout into the side of inlet pressure Pin, and thereby improve the pump efficiency.

Moreover, second pressure introduction grooves 66 and 125 communicate with outlet ports 63 and 122 so that outlet pressure Pout is supplied to second pressure introduction grooves 66 and 125. Second pressure introduction grooves 66 and 125 act mainly in the state of the smallest eccentricity to decrease outlet pressure Pout. Therefore, this groove structure can maintain the force for pushing cam ring 4 toward pressure plate 6 with the supply of outlet pressure Pout, and simultaneously restrain an increase of leakage even if outlet pressure Pout is supplied.

[Variation 2]

Figure 13:
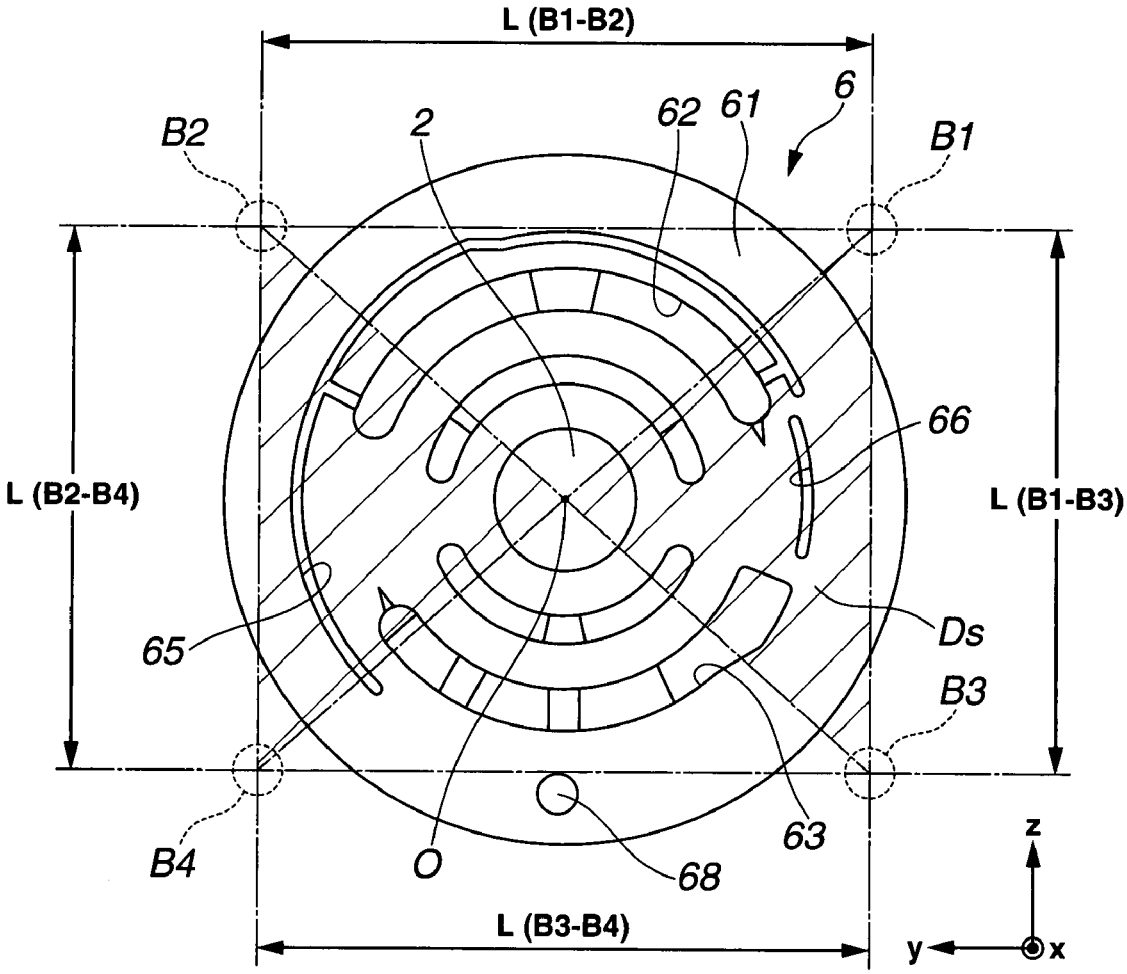
FIG. 13 is a view showing the sliding contact surface of the pressure plate according to a second variation.
Figure 14:
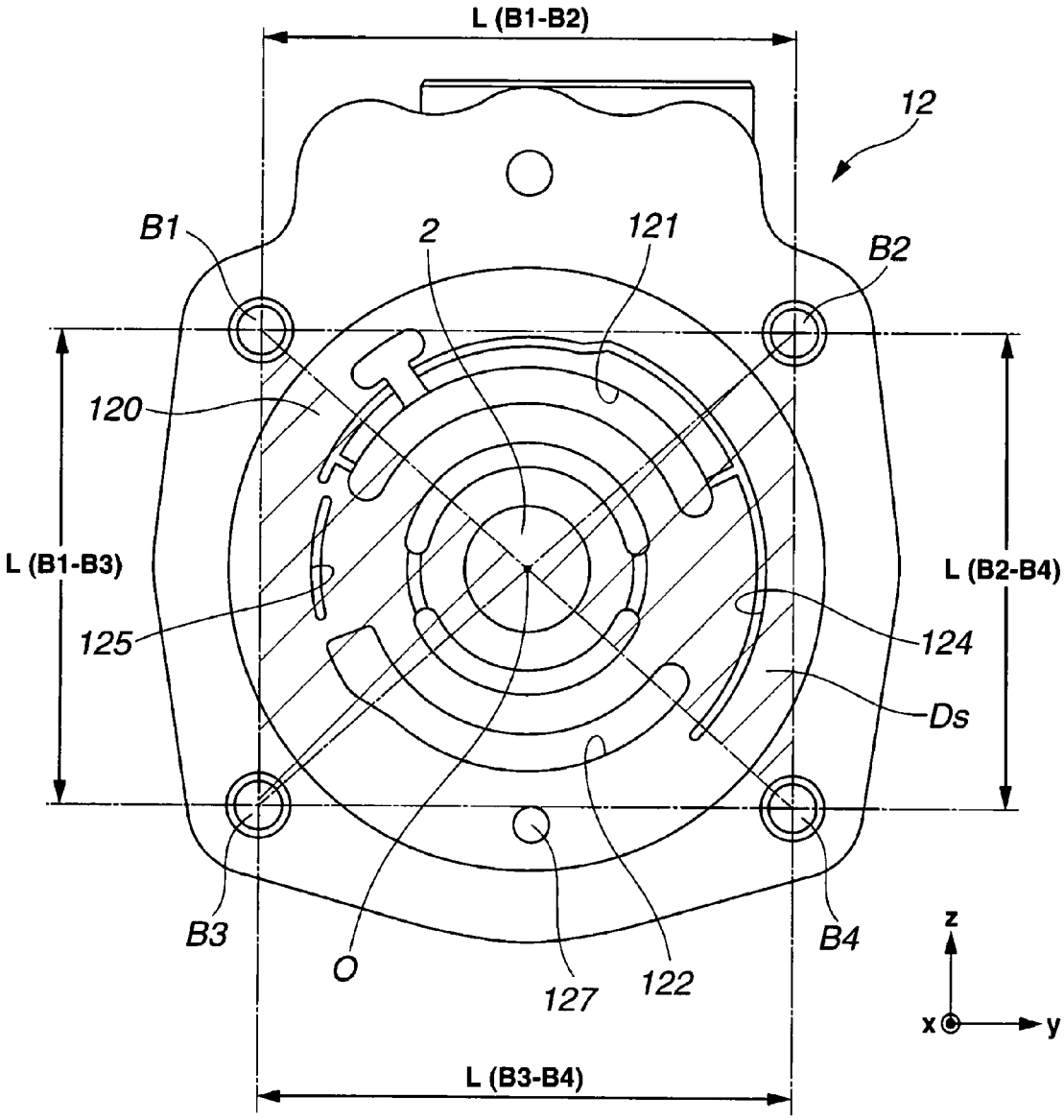
FIG. 14 is a view showing the sliding contact surface of the rear body according to the second variation.

FIG. 13 is a view of pressure plate 6 as viewed from the x-axis positive direction, for showing the sliding contact surface for contacting with rotor 3. FIG. 14 is a view of rear body 12 as viewed from the x-axis negative direction, for showing the sliding contact surface for contacting with rotor 3. In the variation 2, first pressure introduction grooves 65 and 124 are connected, respectively, with inlet ports 62 and 121, and arranged to receive inlet pressure Pin; and second pressure introduction grooves 66 and 125 are so arranged that the inlet pressure Pin is introduced into second pressure introduction grooves 66 and 125 as in the first through third embodiments.

The inlet pressure Pin lower than outlet pressure Pout is introduced into the first grooves 65 and 124 and the second grooves 66 and 125. This groove structure can prevent leakage of the pressurized oil from the first grooves 65 and 124 and the second grooves 66 and 125, and thereby improve the pump efficiency.

Fourth Embodiment

Figure 16:
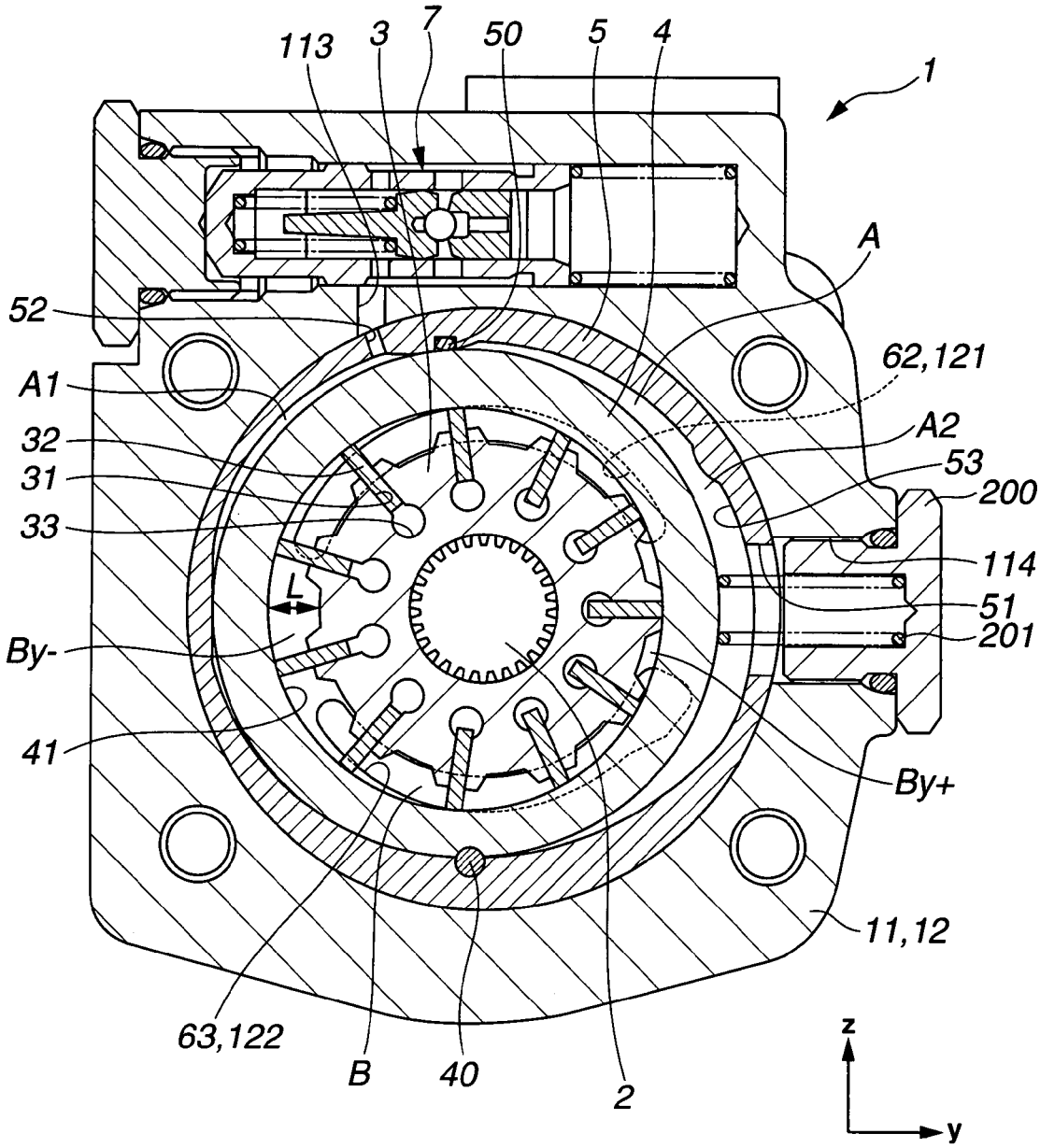
FIG. 16 is a cross sectional view of the vane pump of FIG. 15 (maximum swing state).
Figure 17:
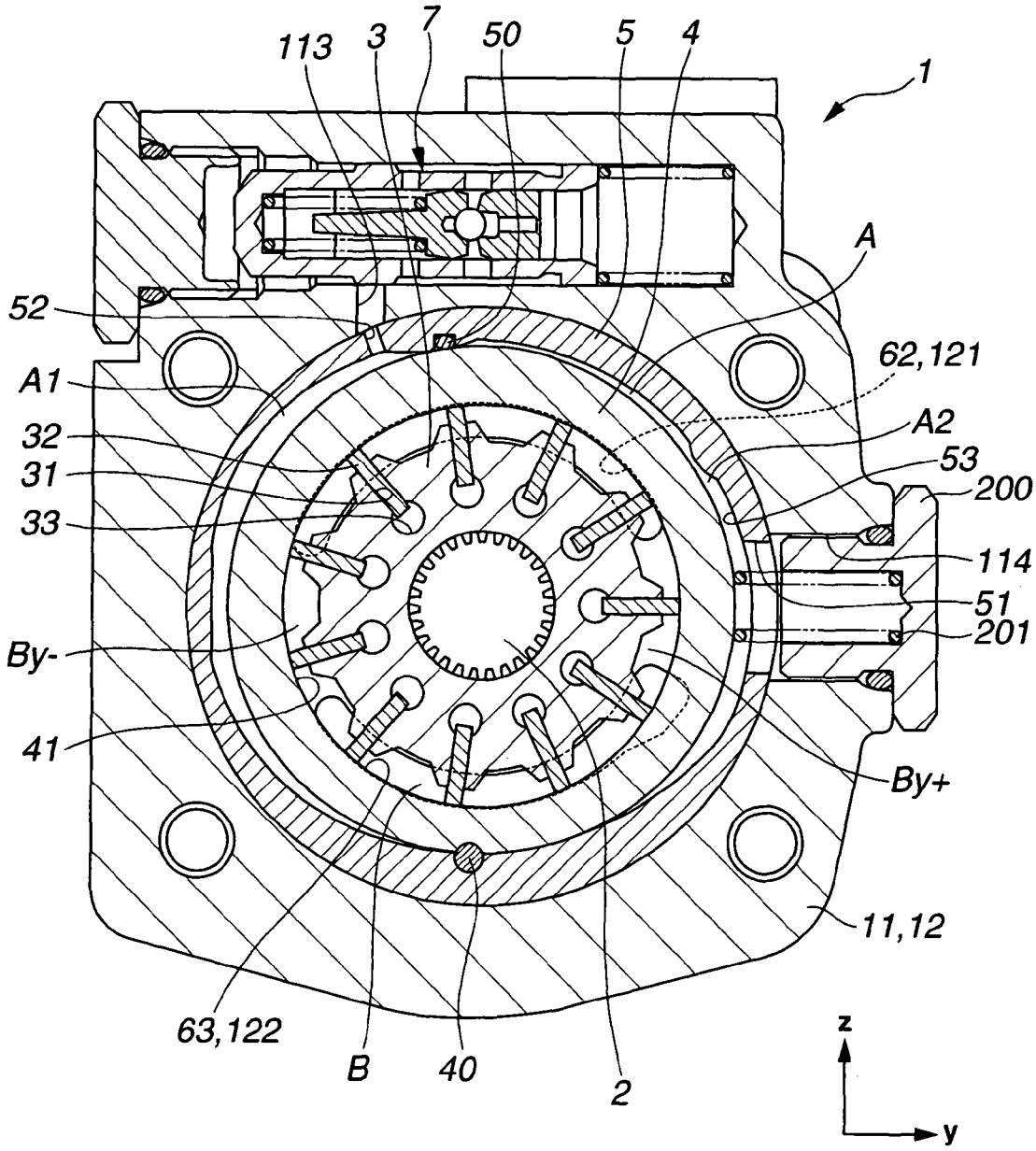
FIG. 17 is a cross sectional view of the vane pump of FIG. 15 (minimum swing state).
Figure 18:
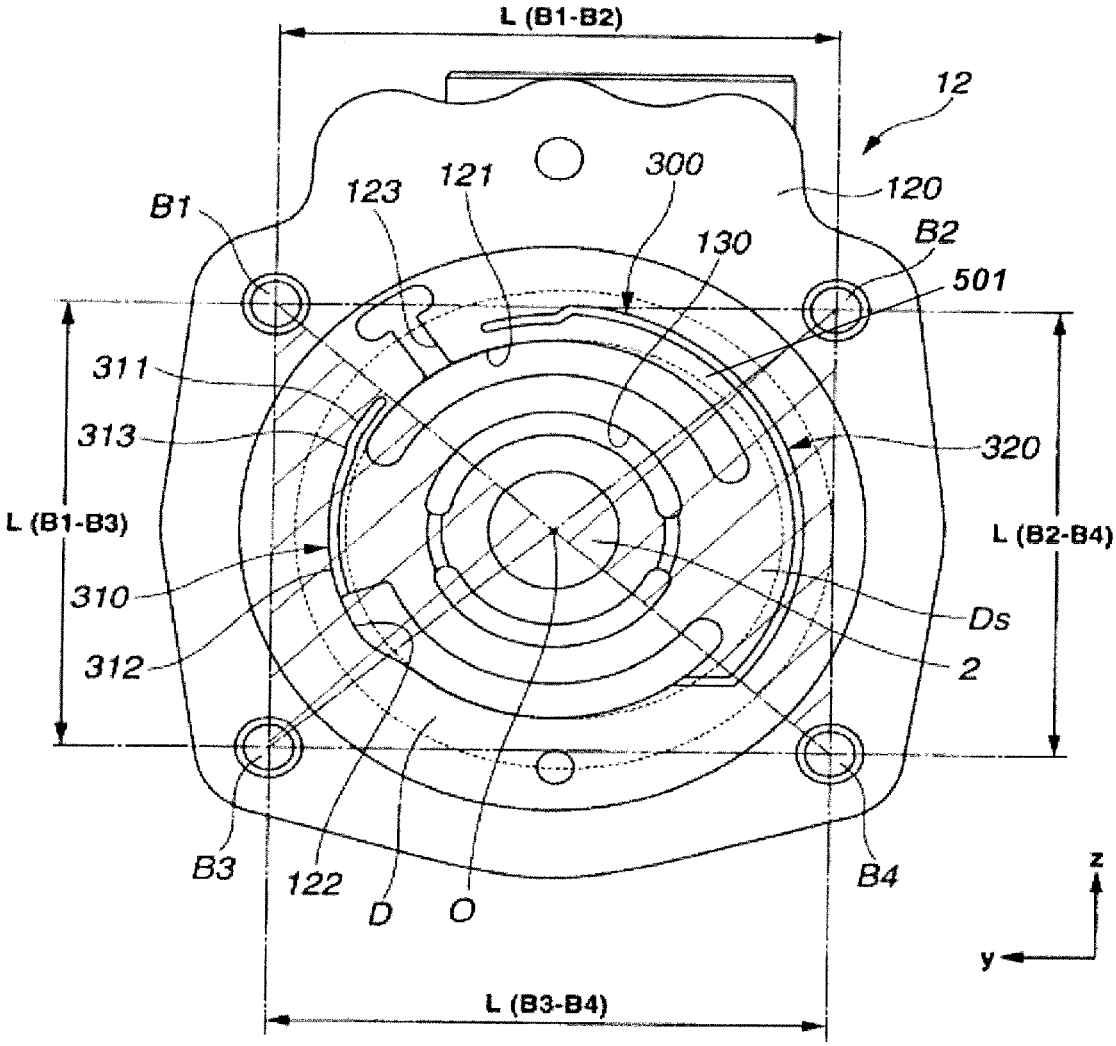
FIG. 18 is a view of a rear body of the vane pump of FIG. 15 for showing an x-axis negative side of the rear body (or second housing).

FIGS. 15-20 show a variable displacement vane pump according to a fourth embodiment of the present invention. The basic construction of the variable displacement vane pump of the fourth embodiment is substantially identical to those of the first, second and third embodiments. Though the first and second pressure introduction grooves 65, 124, 66, 125 of the first embodiment are arranged to receive an intermediate pressure, the rear body 12 of the fourth embodiment is formed with a high pressure introducing groove 300 arranged to receive the outlet pressure. High pressure introducing groove 300 is extended from the outer circumference of outlet port 122, and further extended into a portion on the radial outer side of inlet port 121 (as shown in FIG. 18).

As in the preceding embodiments, front body 11 and rear body 12 are joined together by first and second bolts B1 and B2 on the side of inlet ports 62 and 121, and third and fourth bolts B3 and B4 on the side of outlet ports 63 and 122; and the first average L1 between the interaxis distances L(B1-B2) and L(B3-B4) in the y-axis direction is greater than the second average distance L2 between the interaxis distances L(B1-B3) and L(B2-B4) in the z-axis direction (L1>L2).

Therefore, as in the preceding embodiments, the high pressure introducing groove 300 is formed in a region surrounded by the center axis O of drive shaft 2, and the bolt pairs defining a smaller one of the first and second average distances L1 and L2. In this example, in the sliding contact surface 120, the high pressure introducing groove 300 is formed in the region Ds (shown by hatching in FIG. 18) composed of the first triangular region formed by connecting the center axis O of drive shaft 2, and the axes of first and third bolts B1 and B3 by straight line segments, and the second triangular region formed by connecting the center axis O of drive shaft 2, and the axes of second and fourth bolts B2 and B4 by straight line segments. In the sliding contact surface 120, the high pressure introduction groove 300 is formed between the outlet port 122 and the inlet port 121.

[Outline of Vane Pump]

Figure 15:
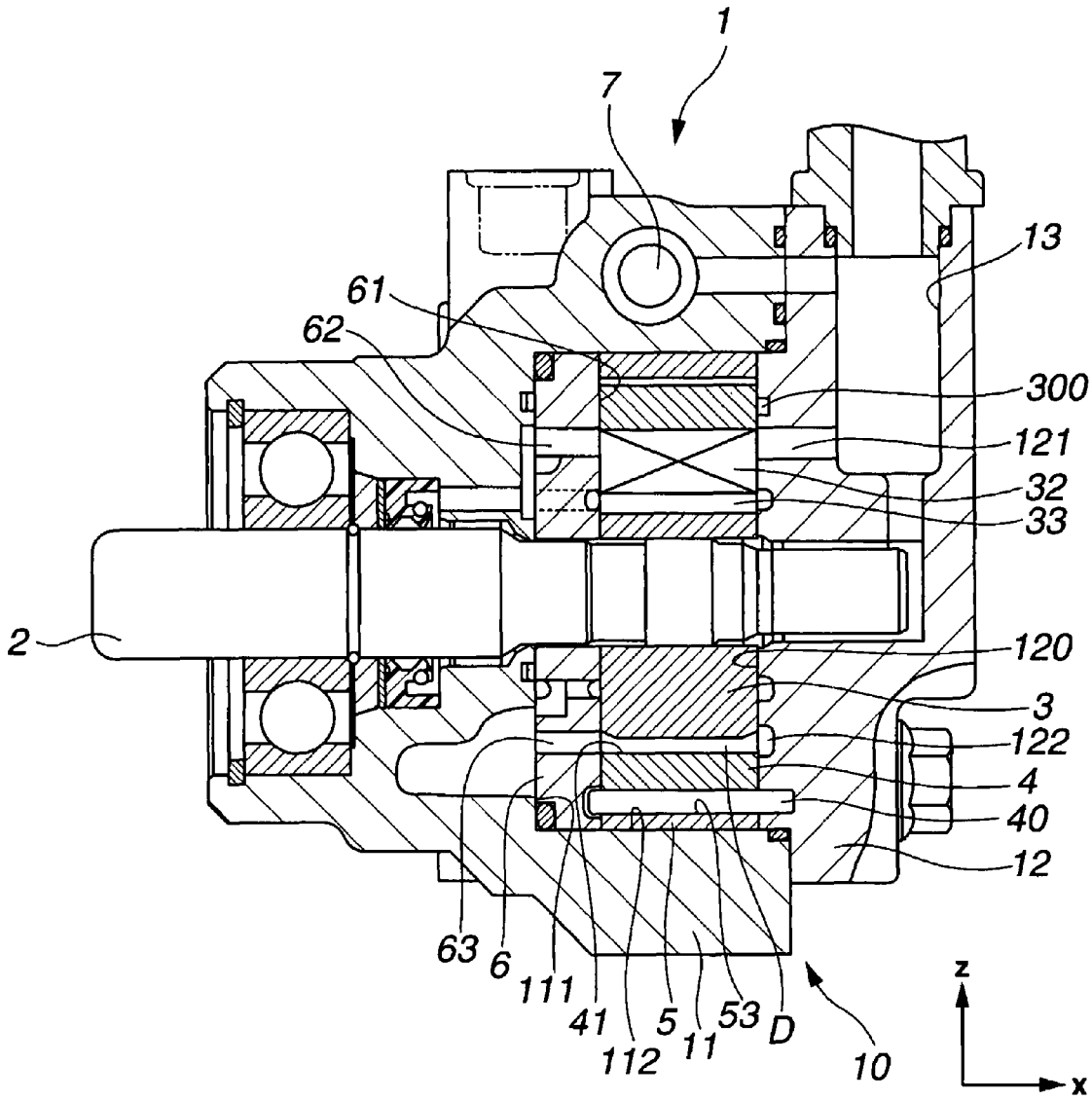
FIG. 15 is a longitudinal sectional view of a vane pump according to a fourth embodiment of the present invention.

FIG. 15 shows, in the form of an axial section, a vane pump 1 according to a fourth embodiment of the present invention; and FIGS. 16 and 17 are cross sectional views. FIG. 16 shows the state in which cam ring 4 is located at the limit position in y-axis negative direction, and the eccentricity of cam ring 4 is greatest, and FIG. 17 shows the state in which cam ring 4 is located at the limit position in y-axis positive direction, and the eccentricity of cam ring 4 is smallest.

The axial direction of drive shaft 2 is the x-axis, and the direction in which drive shaft 2 is inserted into the front body 11 and rear body 12 is defined as the positive direction. The axial direction of spring 201 (shown in FIG. 16) for regulating the swing motion of cam ring 4 is set as the y-axis. The z-axis is perpendicular to the x-axis and to the y-axis.

Vane pump 1 shown in FIG. 15 includes drive shaft 2, rotor 3, cam ring 4, adapter ring 5, pressure plate 6 and pump body 10. Drive shaft 2 is adapted to be connected with an engine through a pulley, and rotor 3 is mounted on drive shaft 2 and coupled with drive shaft 2 so that rotor 3 and drive shaft 2 rotate as a unit.

A plurality of radial slots 31 in the form of axially extending grooves are formed radially in rotor 3. Each radial slot 31 extends radially outwards and opens in the outer circumference of rotor 3. Each radial slot 31 receives one of vanes 32 so that the vane 32 is movable radially in the slot 31. Each slot 31 has back pressure chamber 33 formed at the radial inner end of the slot 31, and arranged to urge the corresponding vane 32 in the radial outward direction when the outlet pressure is supplied to the back pressure chamber 33.

A back pressure introducing groove (170) is formed in the x-axis positive side surface (sliding contact surface) 61 of pressure plate 6; and a back pressure introducing groove 130 is formed in the x-axis negative side surface (sliding contact surface) 120 of rear body 12 as shown in FIG. 18. These back pressure introducing grooves 130 (and 170) supply the outlet pressure into back pressure chambers 33.

Front body 11 and rear body (first plate member or member defining a side wall) 12 are jointed together to form pump body 10. Front body 11 is shaped like a cup, and includes bottom 111 and a circumferential wall (or circumferential wall portion) extending axially from bottom 111 in the x-axis positive direction and opening toward the x-axis positive side (rightwards in FIG. 15, toward rear body 12. Pressure plate (second plate member or member defining a side wall) 6 is disposed on bottom 11 in the inside cavity surrounded by the circumferential wall of front body 11. The circumferential wall of front body 11 defines, therein, the pump element receiving portion 112 in the form of a cylindrical hollow portion. Adapter ring 5, cam ring 4 and rotor 3 are disposed in the pump element receiving portion 112, on the x-axis positive side of pressure plate 6.

Rear body 12 abuts liquid-tightly on the adapter ring 5, cam ring 4 and rotor 3 from the x-axis positive side (from the right side as viewed in FIG. 15). Thus, adapter ring 5, cam ring 4 and rotor 3 are sandwiched axially between pressure plate 6 and rear body 12, and surrounded by the circumferential wall of front body 11.

Rear body 12 includes fluid (oil) passage 13 extending, between first and second bolts B1 and B2, along the z-axis. Fluid passage 13 extends along an imaginary line (in the z-axis direction) connecting a point located substantially at the middle, in the circumferential direction, of inlet port 121 and a point located substantially at the middle of a outlet port 122 in the circumferential direction.

High pressure introducing groove 300 is formed in the x-axis negative side (sliding contact) surface 120 of rear body 12 (as shown in FIGS. 15 and 18). This high pressure introducing groove 300 is formed in a region of the x-axis negative side surface 120 which is always in sliding contact with cam ring 4, and connected with the outlet port 122. Thus, high pressure introducing groove 300 supplies the outlet pressure into the sliding contact interface between cam ring 4 and rear body 12. The outlet pressure is introduced to the sliding contact surfaces between cam ring 4 and rear body 12 substantially over the entire circumferential length, and thereby uniformizes the pressure acting in the sliding contact surfaces.

Inlet ports 62 and 121 and outlet ports 63 and 122 are opened, respectively, in the sliding contact surface 61 which is the side surface of pressure plate 6 on the x-axis positive side and which is in sliding contact with rotor 3, and the sliding contact surface 120 which is the side surface of rear body 12 on the x-axis negative side and which is in sliding contact with rotor 3. Inlet and outlet ports 61, 121, 62 and 122 function to supply and drain the operating fluid (oil) to and from the pump chamber B formed between rotor 3 and cam ring 4 (cf., FIG. 2).

Adapter ring 5 has the inside bore shaped like an ellipse having a major axis along the y-axis and a minor axis along the z-axis. Adapter ring 5 is surrounded by the circumferential wall of front body 11 on the radial outer side, and the adapter ring 5 receives therein the cam ring 4. Adapter ring 5 is fit in the circumferential wall of front body 11 so that adapter ring 5 is non-rotational relative to front body 11. Adapter ring 5 is held stationary in front body 11 in the pump operation. Adapter ring 5 can serve as a circumferential wall surrounding the cam ring 4 and defining first and second pressure chambers A1 and A2.

Circular cam ring 4 is an annular member shaped like a circle and the outside diameter of cam ring 4 is substantially equal to the minor axis of adapter ring 5. The circular cam ring 4 is received in the elliptical bore of adapter ring 5, and there is formed, between the outer circumference of cam ring 4 and the inner circumference of adapter ring 5, the fluid pressure chamber A. Cam ring 4 is swingable in the y-axis direction in adapter ring 5.

First seal member 50 and pin (positioning pin or fulcrum pin) 40 are located, respectively, in a z-axis positive end region (upper end region) and a z-axis negative end region (lower end region) in the inside circumferential surface 53 of adapter ring 5. The z-axis positive end region (upper end region) and the z-axis negative end region (lower end region) in the inside circumferential surface 53 of adapter ring 5 are two regions diametrically opposite to each other along the z-axis across the center axis O of drive shaft 2. By the pin 40 and first seal member 50, the fluid pressure chamber A between the outside circumferential surface of cam ring 4 and the inside circumferential surface 53 of adapter ring 5 is divided into the first fluid pressure chamber A1 on the y-axis negative side (the left side as viewed in FIG. 16) and the second fluid pressure chamber A2 on the y-axis positive side (the right side as viewed in FIG. 16).

Rotor 3 is received in cam ring 4 as shown in FIG. 16, and confined axially between the sliding contact surface 61 of pressure plate 6 and the sliding contact surface 120 of rear body 12 which are flat surfaces confronting axially each other as shown in FIG. 15. The outside diameter of rotor 3 is smaller than the inside diameter of the inside circumferential surface 41 of cam ring 4. Rotor 3 having the smaller outside diameter is thus received in cam ring 4 having the larger inside diameter. The rotor 3 is designed so that the outer circumference of rotor 3 does not abut on the inside circumferential surface 41 of cam ring 4 even if cam ring 4 swings, and the rotor 3 and cam ring 4 move relative to each other.

When cam ring 4 is at the position at which the cam ring 4 swings, to the maximum extent, to the y-axis positive side, the distance (or separation) L between the inside circumferential surface 41 of cam ring 4 and the outside circumferential surface of rotor 3 is greatest on the y-axis negative side. When cam ring 4 is at the position at which the cam ring 4 swings, to the maximum extent, to the y-axis negative side, the distance (or separation) L between the inside circumferential surface 41 of cam ring 4 and the outside circumferential surface of rotor 3 is greatest on the y-axis positive side.

The radial length of each vane 32 is greater than the maximum value of the distance L between the inside circumferential surface 41 of cam ring 4 and the outside circumferential surface of rotor 3. Accordingly, irrespective of changes in the relative position between cam ring 4 and rotor 3, each vane 32 remains in the state in which the radial inner portion of the vane 32 is received in the corresponding slot 31 of rotor 3, and the radial outer portion of the vane 32 projects from the slot 31 and abuts on the inside circumferential surface 41 of cam ring 4. Each vane 32 always receives the back pressure in the corresponding back pressure chamber 33, and abuts on the inside circumference surface 41 of cam ring 4 liquid-tightly.

Therefore, in the annular space between cam ring 4 and rotor 3, adjacent two of vanes 32 define a pumping chamber B always sealed liquid-tightly. When the rotor 3 and cam ring 4 are in the eccentric state by the swing motion, the volume of each pumping chamber B varies with rotation of rotor 3.

By the volume variation of each pumping chamber B, the operating fluid is supplied or returned through the intake ports 62 and 121 and outlet ports 63 and 122 formed along the outer circumference of rotor 3 in the pressure plate 6 and rear body 12.

Adapter ring 5 is formed with radial through hole 51 opening to the y-axis positive side (to the right side as viewed in FIG. 16). Front body 11 is formed with plug insertion hole 114 on the y-axis positive side. Plug member 200 shaped like a cup having a bottom is inserted in the plug insertion hole 114 of front body 11, and arranged to seal the inside of vane pump 1 liquid-tightly with front body 11 and rear body 12.

The before-mentioned spring 201 is received in plug member 200 so that spring 201 can extend and compress in the y-axis direction. Spring 201 extends through radial through hole 51 of adapter ring 5, and abuts on cam ring 4. This spring 201 urges cam ring 4 in the y-axis negative direction toward the swing position at which the eccentricity is greatest.

In this example, the opening of radial through hole 51 of adapter ring 5 is used as a stopper for limiting the swing motion of cam ring 4 in the y-axis positive direction. However, it is optional to use the plug member 200 as the stopper. In this case, plug member 200 for serving as the stopper extends through radial through hole 51 and projects into the radial inner side of adapter ring 5.

[Supply of Pressurized Oil to First and Second Pressure Chambers]

Pressure chamber communicating hole 52 is formed in the z-axis positive side portion (or upper portion) of adapter ring 5 at a position on the y-axis negative side of first seal member 50 (on the left side of seal member 50 as viewed in FIG. 16). This communicating hole 52 is connected, through fluid (oil) passage 113 formed in front body 11, with control valve 7 (as a main component of pressure controlling means). This communicating hole 52 connects the first pressure chamber A1 on the y-axis negative side (on the left side in FIG. 16), with control valve 7.

The inlet pressure and outlet pressure of vane pump 1 are introduced to control valve 7, which is arranged to change a fluid pressure introduced into first pressure chamber A1. In the x-axis negative side surface (sliding contact surface) 120 of rear body 12, there is formed an inlet pressure introducing groove 123 (as shown in FIG. 18) to introduce the inlet pressure always into second pressure chamber A2.

Therefore, cam ring 4 is urged, in pressure chamber A, in the y-axis positive direction by the pressure in first pressure chamber A1 located on the y-axis negative side, and in the y-axis negative direction by the pressure in second pressure chamber A2 located on the y-axis positive side.

[Swing Motion of Cam Ring]

When an urging force F1 in the y-axis positive direction which cam ring 4 receives from the oil pressure P1 in first pressure chamber A1 is greater than a sum F2 in the y-axis negative direction of an urging force due to the oil pressure P2 in second pressure chamber A2 and an urging force of spring 201, then cam ring 4 swings about pin 40 in the y-axis positive direction toward spring 201. By this swing motion of cam ring 4, the volume of a pumping chamber By+ on the y-axis positive side is increased, and the volume of a pumping chamber By− on the y-axis negative side is decreased (cf. FIG. 16).

When the volume of pumping chamber By− on the y-axis negative side is decreased, the quantity of the oil supplied per unit time from inlet ports 62 and 121 to outlet ports 63 and 122 decreases, and hence the outlet pressure decreases. Accordingly, the pressure P1 in first pressure chamber A1 to which the outlet pressure is introduced is decreased. When the pressure P1 in first pressure chamber A1 decreases to such a low level incapable of withstanding the total urging force F2 in the y-axis negative direction by the pressure in second pressure chamber A2 and spring 201, then the cam ring 4 swings about the axis of pin 40 in the y-axis negative direction (cf. FIG. 17).

The opposite urging forces F1 and F2 in the y-axis positive and negative directions become approximately equal to each other, the cam ring 4 comes to rest in the balanced state of the opposite urging forces along the y-axis. When the outlet pressure further decreases, the cam ring 4 further swings in the y-axis negative direction to the (coaxial) position at which the axis of cam ring 4 coincides with the axis of rotor 3. At this (coaxial) position, the volumes of pumping chambers By+ and By− on the y-axis positive side and the y-axis negative side become equal to each other, and hence the outlet pressure becomes equal to the inlet pressure (inlet pressure=outlet pressure=0).

Therefore, the pressure P1 in first pressure chamber A1 becomes equal to a minimum level (0), and the cam ring 4 is urged in the y-axis negative direction by the urging force F of spring 201. In this way, the eccentricity of cam ring 4 is adjusted so as to make constant a differential pressure on both sides of an outlet orifice.

[Details of High Pressure Introducing Groove]

FIG. 18 is a front view showing the y-axis negative side of rear body 12. A region D surrounded by a broken line is a sliding region of the slide motion of cam ring 4. As mentioned before, the x-axis negative side (sliding contact) surface 120 of rear body 12 is formed with the high pressure introducing groove 300 for making the pressure acting on the sliding contact surface uniform. High pressure introducing groove 300 is formed integrally in rear body 12 simultaneously with the operation of forming rear body 12 by a production method such as aluminum die casting, in order to reduce the number of fabricating steps.

High pressure introducing groove 300 of this example includes a first groove 310 on the y-axis positive side of the center axis O, and a second groove 320 including a segment on the y-axis negative side of the center axis O. Each of first and second grooves 310 and 320 extends from outlet port 122, to a groove portion formed on the radial outer side of inlet port 121. Inlet port 121 is surrounded almost entirely by first and second grooves 310 and 320. In order to supply a high pressure securely into the sliding contact interface between cam ring 4 and rear body 12, the high pressure introducing groove 300 is formed within the sliding contact region D, and each of first and second grooves 310 and 320 is curved in the form of a circular arc around the center axis O.

Inlet port 121 and outlet port 122 of this example are shaped like a circular arc, and extend so as to describe arcs of the same circle around the center axis O of center hole receiving drive shaft 2. Namely, the radial distance of inlet port 121 from the center axis O is equal to the radial distance of outlet port 122 from the center axis O. Therefore, the high pressure introducing groove 300, if extended circumferentially at the radial distance of outlet port 122 toward inlet port 121, would come so close to inlet port 121 as to allow leakage into inlet port 121, of the outlet pressure introduced into high pressure groove 300.

In order to prevent such leakage, the first groove 310 of this example includes a first groove segment 311 which overlaps the inlet port 121 in the radial direction; a second groove segment 312 connecting the first groove segment 311 to outlet port 122; and a step portion 313 by which first and second groove segments 311 and 312 are connected. The first groove segment 311 is in the form of an arc of a larger circle, and the second groove segment 312 is in the form of an arc of a smaller circle whose diameter is smaller than the diameter of the larger circle of first groove segment 311.

Though second groove segment 312 is located at the radial position of outlet port 122, the first groove segment 312 is separated radially from inlet port 121 by a sufficient radial distance to restrain the leakage of the outlet pressure into inlet port 121.

[Uniform Deformation and Restraint of One-side Wearing]

Figure 19:
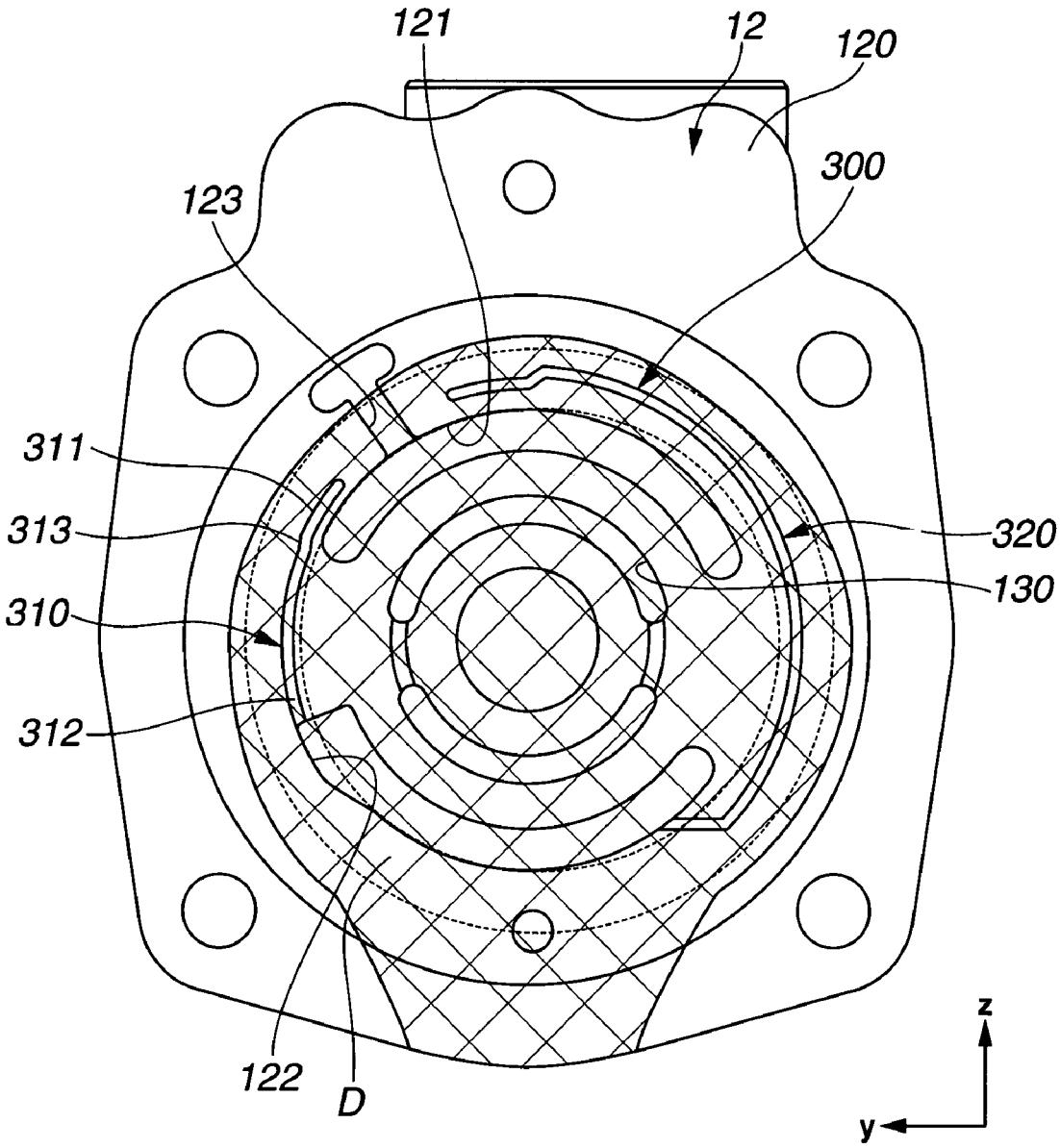
FIG. 19 is a view for illustrating deformation distribution in the rear body of the vane pump of FIG. 15.

FIG. 19 is a view for illustrating a deformation distribution in the x-axis negative side surface 120 of rear body 12 in the pump driving operation. As in FIG. 18, the sliding contact region D with cam ring 4 is shown by a broken line. A shaded region is a region in which the deformation is uniform in the x-axis direction.

The outlet pressure of vane pump 1 is introduced from outlet port 122 into high pressure introducing groove 300. The first and second grooves 310 and 320 of high pressure introducing groove 300 are so arranged the outlet pressure acts almost over the entire circumference including the portion on the radial outer side of inlet port 121. Furthermore, the back pressure introducing groove 130 for supplying the outlet pressure to the back pressure chambers 33 of rotor 3 is surrounded by inlet and outlet ports 121 and 122. Thus, the outlet pressure acts on both of the radial outer side and radial inner side of inlet port 121.

Therefore, in the x-axis negative side surface 120 of rear body 12, the outlet pressure acts almost uniformly over the entire circumference at both of the radial position of an imaginary smaller circle surrounded by the inlet and outlet ports 121 and 122, and the radial position of an imaginary larger circle surrounding the inlet and outlet ports 121 and 122, so that the deformation in the x-axis positive direction is uniform. Therefore, the region D in sliding contact with cam ring 4 is deformed uniformly over the entire circumference, in the x-axis positive direction.

Therefore, even if the outlet pressure is applied on the x-axis negative side of rear body 12 by the driving operation of the pump, the deformation along the x-axis of the sliding contact region D is uniform over the entire area, and the sliding contact region D is held flat. As a result, cam ring 4 abuts on rear body 12 uniformly and symmetrically around the center axis O in a manner to prevent nonuniform or asymmetric wearing.

The introduction of the outlet pressure into the sliding contact interface between cam ring 4 and rear body 12 is also effective for improving the lubrication and thereby further preventing nonuniform wearing. The high pressure introduced into high pressure introducing groove 300 functions to restrain deformation of rear body 12 by causing a reaction force to cam ring 4. Accordingly, the high pressure introducing groove 300 shaped in conformity with the shape of cam ring 4 can restrain the deformation of rear body 12.

Comparison between Comparative Example and Fourth Embodiment

Figure 20:
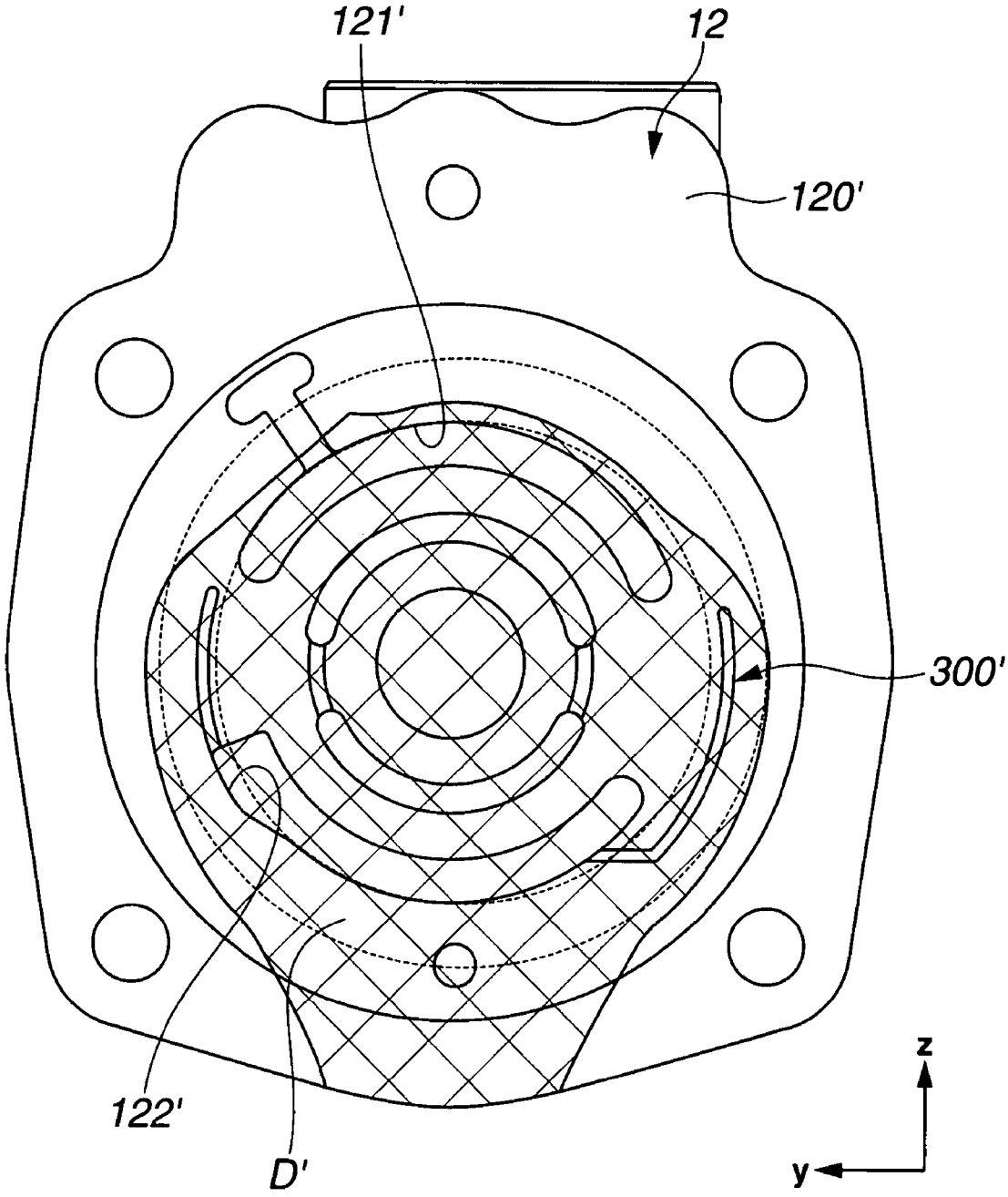
FIG. 20 a view for illustrating deformation distribution in the rear body of the vane pump in a comparative example of earlier technology.

FIG. 20 shows a deformation distribution in a x-axis negative side surface 120' of a rear body 12' in a comparative example of earlier technology. A shaded region is a region in which the deformation is uniform. In this comparative example, too, a high pressure introducing groove 300' is formed in a region between an inlet port 121' and an outlet port 122' and arranged to introduce the outlet pressure of the pump.

However, the high pressure introducing groove 300' does not extends into the radial outer side of inlet port 121', so that the deformation is not uniform in the sliding contact region D' with a cam ring 4. Therefore, there might be formed irregularities in the sliding contact region D' due to the deformation, causing nonuniform wearing between the cam ring 4 and rear body 12.

By contrast, the high pressure introducing groove 300 according to the fourth embodiment extends from a region on the radial outer side of outlet port 122 to a region on the radial outer side of inlet port 121, and nearly covers the inlet port. On the radial outer side of inlet port 121, the high pressure introducing groove 300 extends through an imaginary median plane containing the center axis, extending in parallel to the z-axis and dividing the inlet port into left and right substantially equal halves, from one side (right side in FIG. 19) of the median plane to the other side (left side in FIG. 19). High pressure introducing groove 300 extends circumferentially alongside the inlet port 121 on the radial outer side of inlet port, and thereby covers a major segment of inlet port having a circumferential length greater than a half of the entire circumferential length of inlet port 121.

The thus-constructed high pressure introducing groove 300 can make substantially uniform the deformation in the x-axis positive direction all over the circumference of the sliding region D of rear body 12 which is the sliding contact surface with cam ring 4, and maintain the sliding region substantially flat. Therefore, in addition to the effects (1)~(12) of the first through third embodiments, the vane pump can cause the cam ring 4 to abut uniformly around the circumference on rear body 12, and thereby restrain undesired irregular wearing. Moreover, the introduction of the outlet pressure to the sliding contact surface between cam ring 4 and rear body 12 functions to improve the lubrication, and further to restrain the irregular wearing.

Moreover, the high pressure introducing groove 300 is connected with outlet ports 63, 122. Therefore, it is possible to introduce a high pressure (outlet pressure) into high pressure introducing groove 300.

Figure 21:
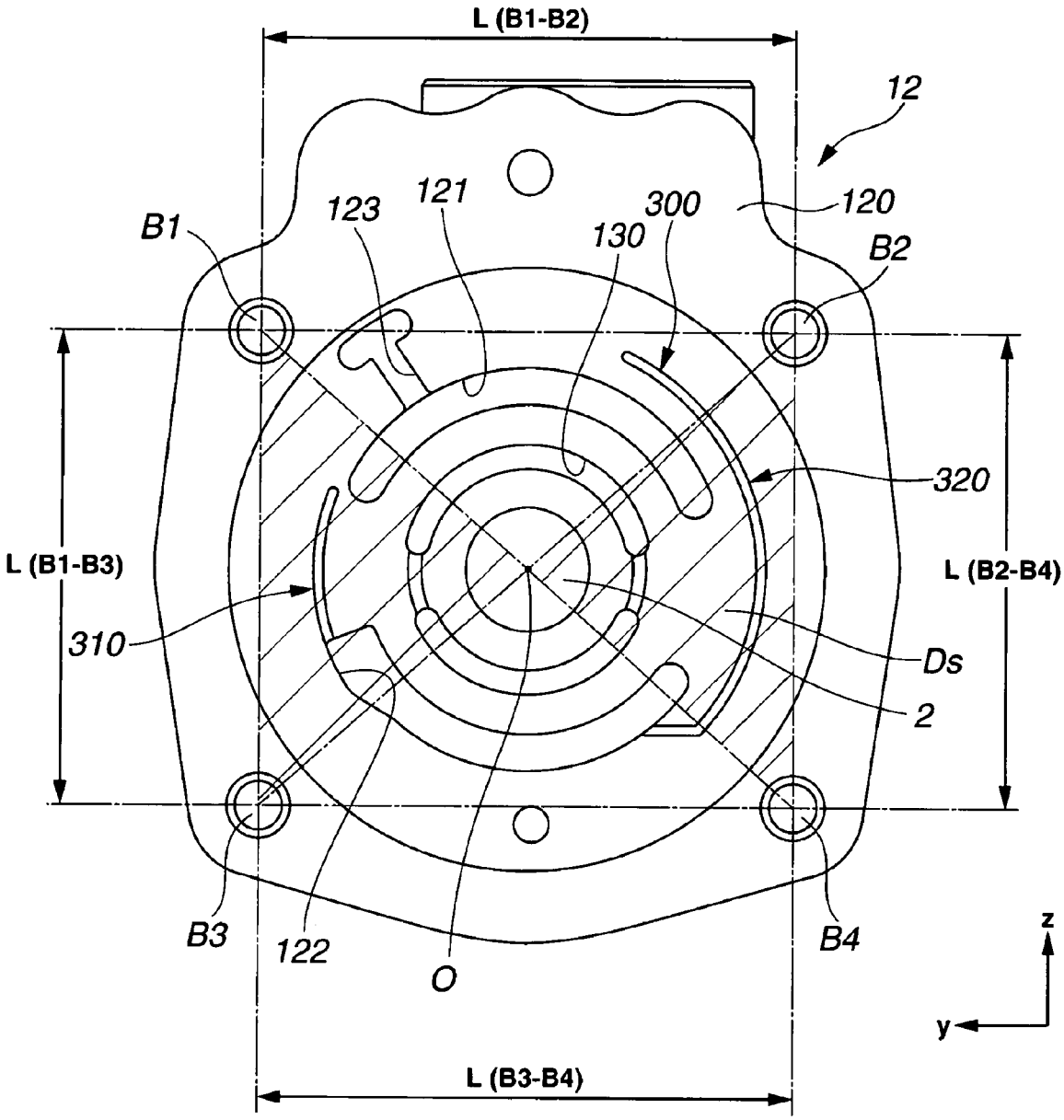
FIG. 21 is a view of the rear body of the vane pump according to a variation 4-1 for showing an x-axis negative side of the rear body (or second housing).
Figure 22:
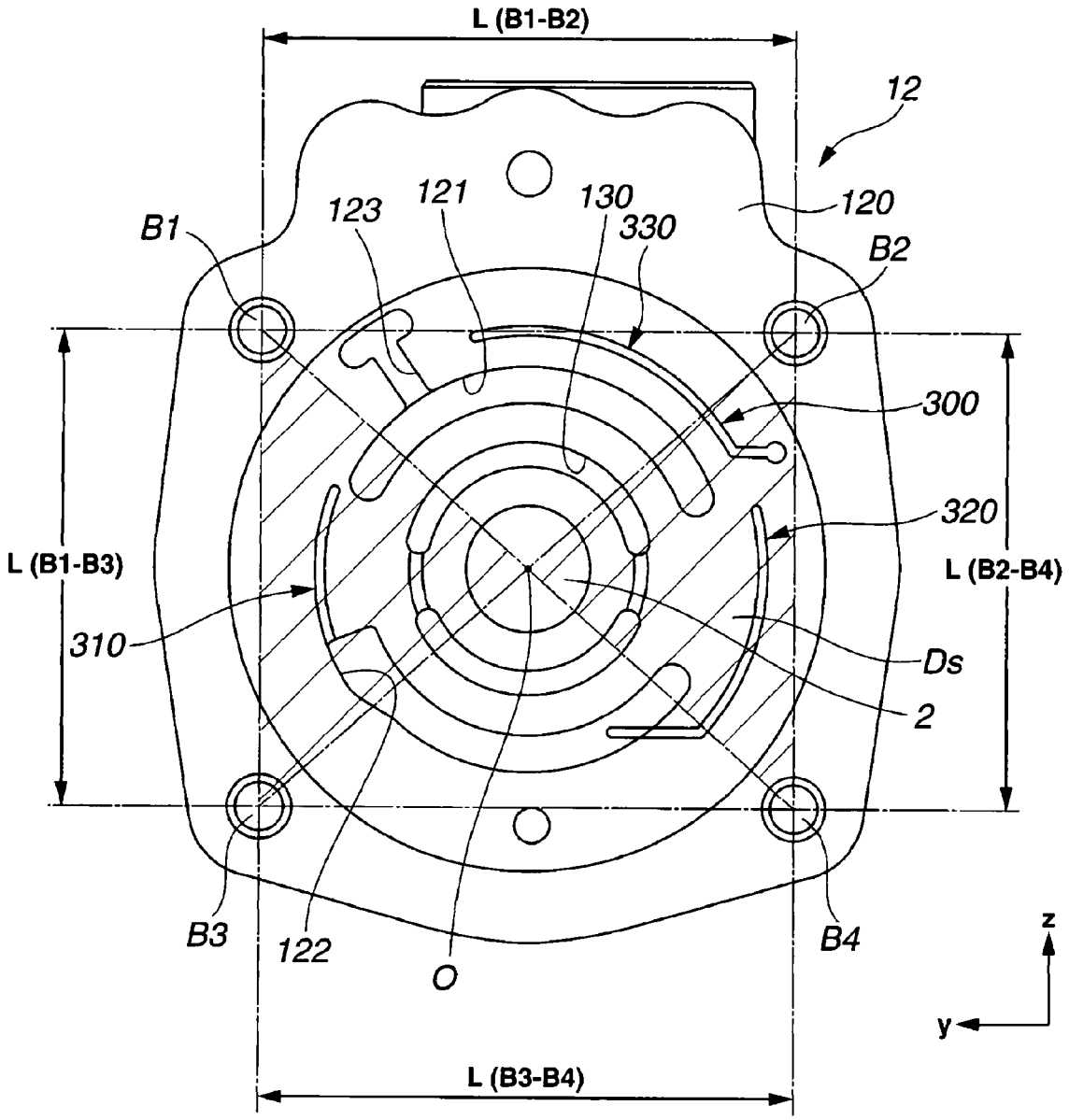
FIG. 22 is a view of the rear body of the vane pump according to a variation 4-2 for showing the x-axis negative side of the rear body.
Figure 23:
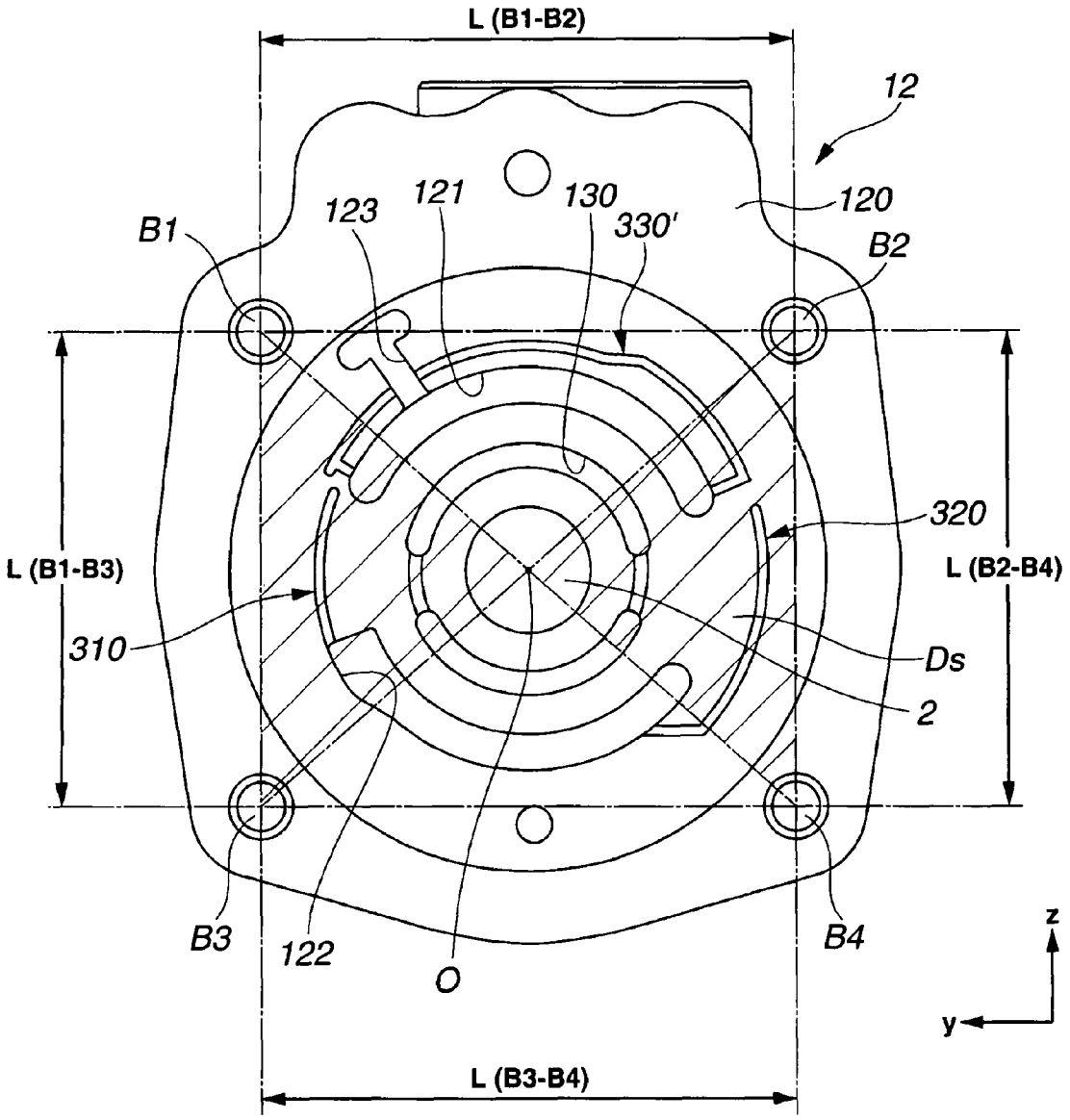
FIG. 23 is a view of the rear body of the vane pump according to a variation 4-3 for showing the x-axis negative side of the rear body.

FIGS. 21, 22 and 23 show variations of the fourth embodiments.

First Variation 4-1 of Fourth Embodiment

In an example shown in FIG. 21, the first groove segment 311 overlapping inlet port 121 in the radial direction is omitted. The first groove 310 of this example includes only the (second) groove segment 312 extending circumferentially from outlet port 122. High pressure introducing groove 300 further includes the second groove 320 extending into the sectorial region in which inlet port 121 is bounded, and overlapping inlet port 121, on the radial outer side of inlet port 121. Therefore, high pressure introducing groove 300 of this example, too, can introduce the outlet pressure almost over the entirety of the sliding region D as in the high pressure introducing groove 300 shown in FIG. 18.

Second Variation 4-2 of Fourth Embodiment

In an example shown in FIG. 22, there is provided a third pressure introducing groove 330 on the radial outer side of inlet port 122. Third pressure introducing groove 330 is arranged so that an intermediate pressure intermediate between the outlet pressure and inlet pressure is introduced into third pressure introducing groove 330. Third pressure introducing groove 330 (serving as a lower or intermediate pressure introducing groove) does not communicate with outlet port 122. When the outlet pressure becomes high, the application of the outlet pressure between cam ring 4 and rear body 12, by high pressure introducing groove 300 tends to separate the cam ring 4 and rear body 12 apart from each other and to increase the possibility of leakage of the outlet pressure. The third pressure introducing groove 330 receiving the intermediate pressure acts to lower the possibility of the leakage. In the example of FIG. 22, each of the first groove 310 and second groove 320 of the high pressure introducing groove 300 does not overlap the inlet port 121 in the radial direction.

Third Variation 4-3 of Fourth Embodiment

In an example shown in FIG. 23, there is provided a third pressure introducing groove 330' located on the radial outer side of inlet port 122, and connected with inlet port 121. The inlet pressure is introduced into this third pressure introducing groove 330', and the vane pump can prevent the leakage even when the outlet pressure is further increased beyond the level of the second variation 4-2.

These three variations can provide the effects of the fourth embodiments.

Fifth Embodiment

Figure 24:
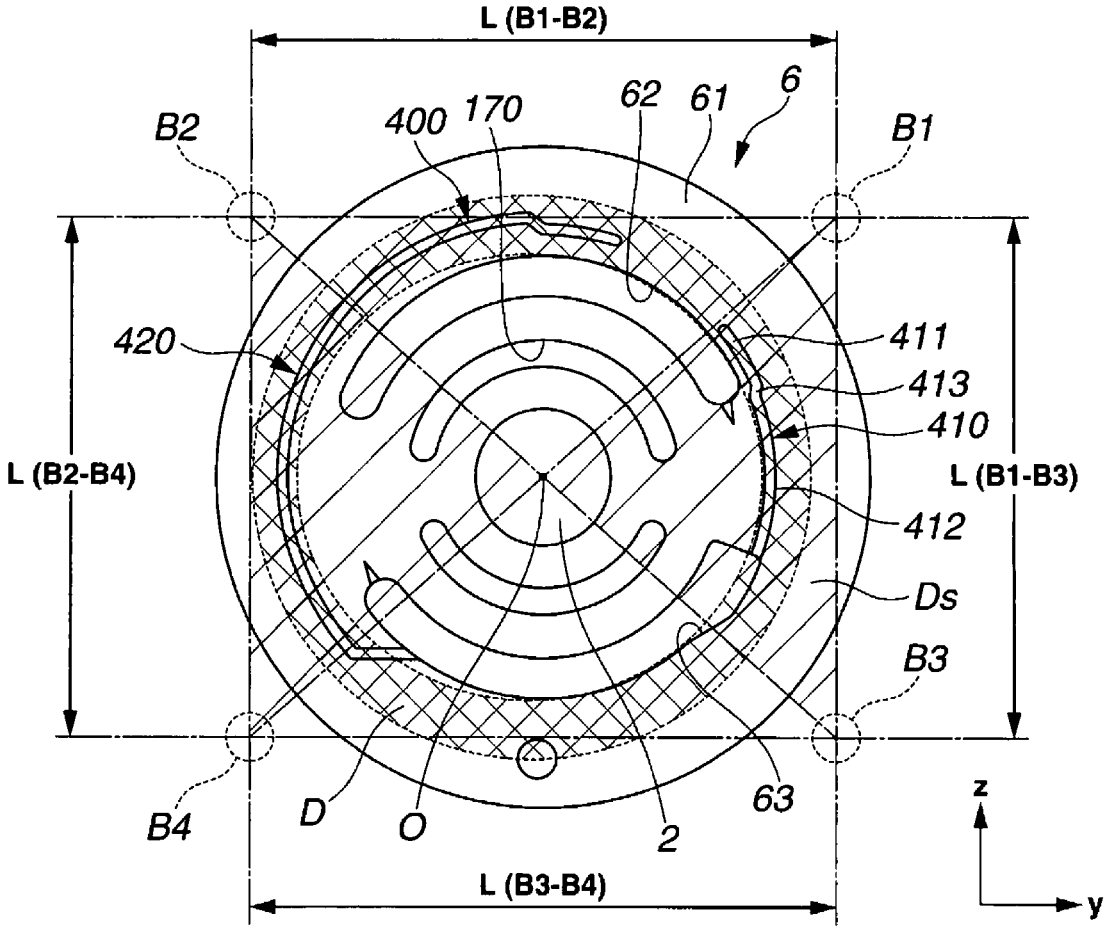
FIG. 24 is a view of a pressure plate of the vane pump according to a fifth embodiment, for showing an x-axis positive side of the rear body.

FIGS. 24 and 26 (26A, 26B) show a variable displacement vane pump according to a fifth embodiment of the present invention. The basic construction is the same as that of the fourth embodiment. Although the high pressure introducing groove 300 of the fourth embodiment is formed in the x-axis negative side surface 120 of rear body 12, the vane pump according the fifth embodiment includes a high pressure introducing groove 400 formed in the x-axis positive side surface 61 of pressure plate 6.

[Front View of Pressure Plate]

FIG. 24 is a front view showing the x-axis positive side of pressure plate 6 of the fifth embodiment. The high pressure introducing groove 400 is formed in the x-axis positive side surface 61 of pressure plate 6. Like the high pressure introducing groove 300 of rear body 12 in the fourth embodiment, the high pressure introducing groove 400 of the fifth embodiment includes a first groove 410 on the y-axis positive side of the center axis O, and a second groove 420 including a segment on the y-axis negative side of the center axis O. First and second grooves 410 and 420 extend from outlet port 122 in the opposite circumferential direction (counterclockwise and clockwise directions as viewed in FIG. 24), into an outer arc region which is a part of a surrounding annular region surrounding an inner region in which inlet port 121 is formed, and which is bounded by two radii between which inlet port 121 is bounded circumferentially, so that each of first and second groove 410 and 420 extends circumferentially around the center axis, alongside the inlet port 121 on the radial outer side of inlet port 12, so that the circumferential length of inlet port 121 is covered almost entirely by first and second grooves 410 and 420. In order to supply a high pressure securely into the sliding contact interface between cam ring 4 and pressure plate 6, the high pressure introducing groove 400 is formed within the sliding contact region D, and each of first and second grooves 410 and 420 is curved in the form of a circular arc around the center axis O in conformity with the shape of the circular cam ring 4.

Like the first groove 310 FIG. 18, the first groove 410 of FIG. 24 includes a first groove segment 411 which overlaps the inlet port 62 in the radial direction; a second groove segment 412 connecting the first groove segment 411 to outlet port 63; and a step portion 413 by which first and second groove segments 411 and 412 are connected. The first groove segment 411 is in the form of an arc of a larger circle, and the second groove segment 412 is in the form of an arc of a smaller circle whose diameter is smaller than the diameter of the larger circle of first groove segment 411. Thus, first groove segment 412 is separated radially from inlet port 121 by a sufficient radial distance to restrain the leakage of the outlet pressure into inlet port 62.

[Uniform Deformation and Restraint of One-side Wearing]

Figure 25B:
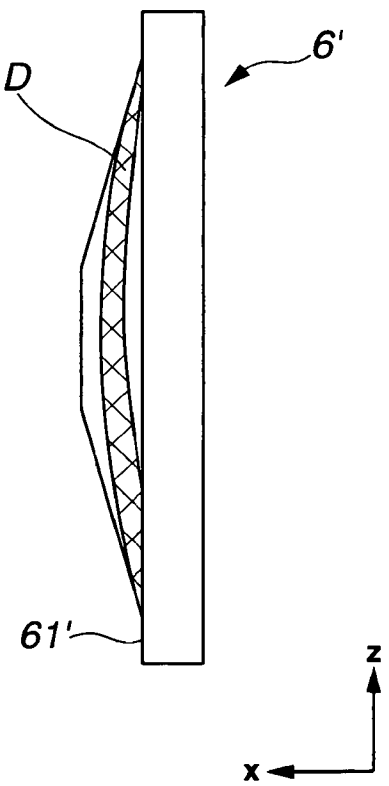
FIGS. 25A and 25B are views for illustrating pressure distribution in the pressure plate in a comparative example of earlier technology.
Figure 25A:
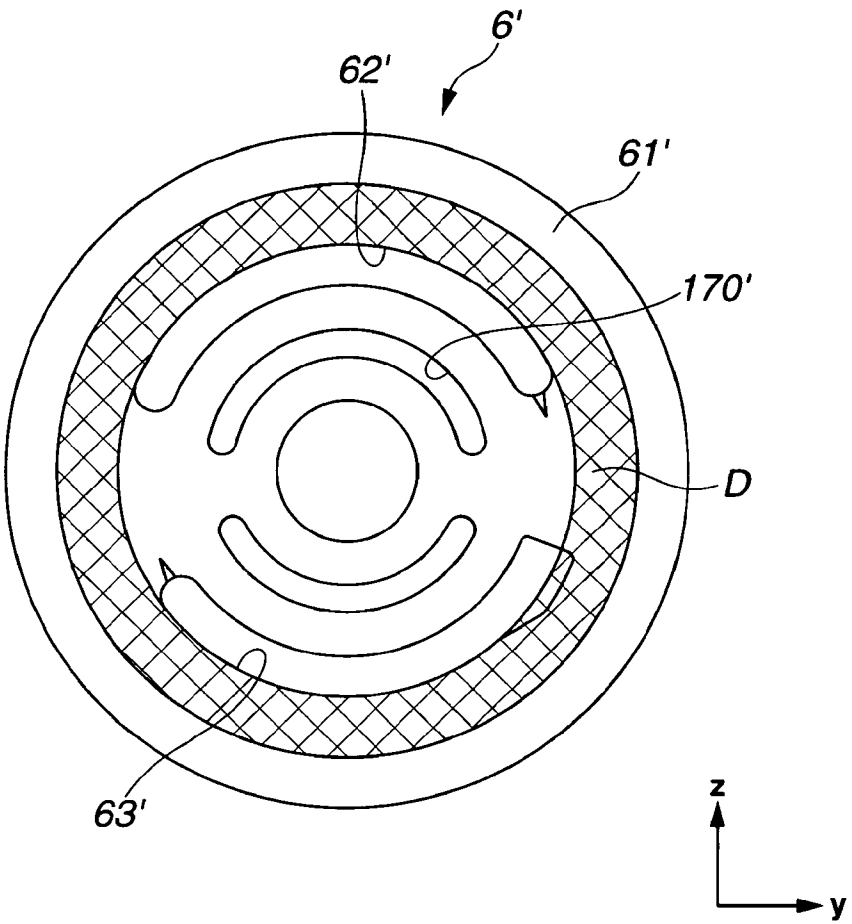
Figure 26B:
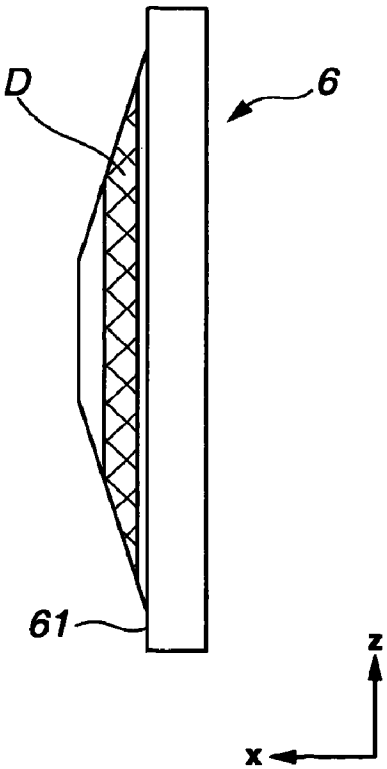
FIGS. 26A and 26B are views for illustrating pressure distribution in the pressure plate according to the fifth embodiment.
Figure 26A:
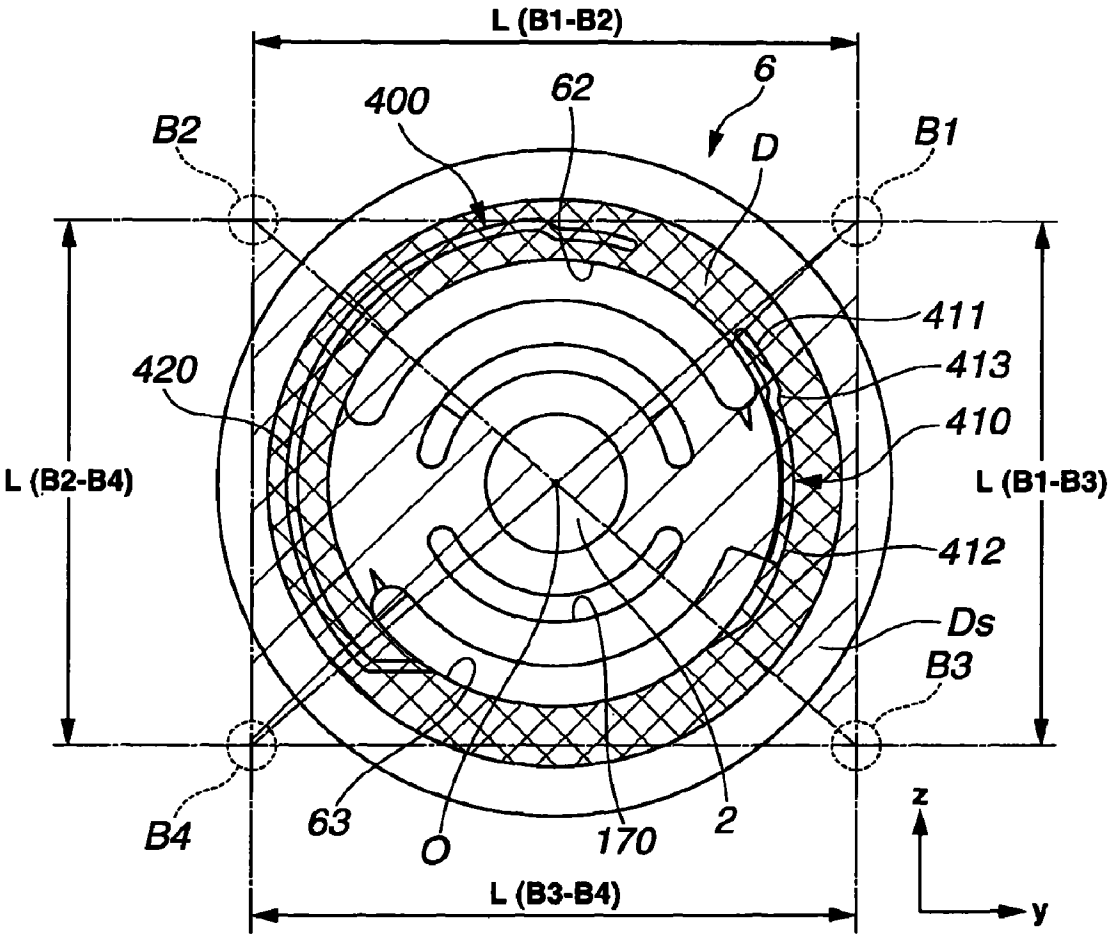

FIGS. 25A and 25B show a deformation distribution in a pressure plate 6' of a comparative example, respectively in the form of a front view as viewed from the x-axis positive side and a side view in the y-axis direction. FIGS. 26A and 26B show a deformation distribution in the pressure plate 6 according to the fourth embodiment, respectively in the form of a front view as viewed from the x-axis positive side and a side view in the y-axis direction. In the case of the comparative example shown in FIGS. 25A and 25B, the z-axis positive side (upper side) of pressure plate 6' is acted upon by the inlet pressure from the inlet port 62', and the z-axis negative side (lower side) of pressure plate 6' is acted upon by the outlet pressure from the outlet port 63'.

Therefore, the pressure applied on the z-axis positive side differs from the pressure applied on the z-axis negative side, and the deformation of pressure plate 6' becomes nonuniform between the z-axis positive side and the z-axis negative side. Consequently, there appear, in the sliding contact region D of pressure plate 6', nonuniformity such as projections and depressions, resulting irregular wear of pressure plate 6' and cam ring 4.

By contrast to the comparative example, the high pressure introducing groove 400 formed in pressure plate 6 functions to make uniform the deformation by applying the outlet pressure almost uniformly around the center axis on pressure plate 6. Consequently, the sliding contact surface D of pressure plate 6 with cam ring 4 is deformed in the x-axis positive direction uniformly around the center axis, and cam ring 4 abuts on pressure plate 6 uniformly. Thus, the vane pump according to the fourth embodiment can avoid nonuniform wearing.

Figure 27:
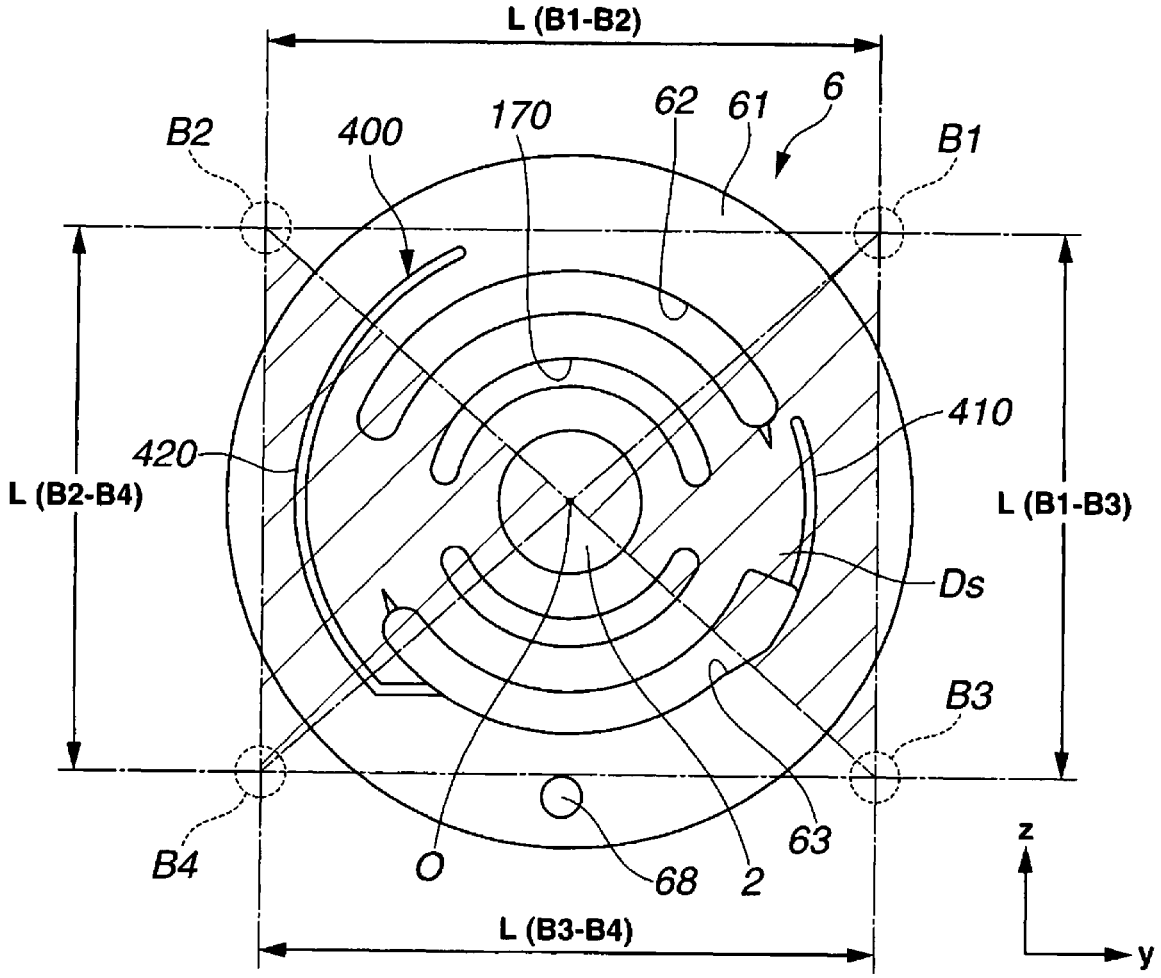
FIG. 27 is a view of the pressure plate of the vane pump according to a variation 5-1, for showing the x-axis positive side of the rear body.

FIG. 27 shows variation of the fifth embodiment.

Variation 5-1 of Fifth Embodiment

In an example shown in FIG. 27, the first groove segment 411 overlapping inlet port 62 in the radial direction is omitted. The first groove 410 of this example includes only the (second) groove segment 412 extending circumferentially from outlet port 63. High pressure introducing groove 400 further includes the second groove 420 extending into the sectorial region in which inlet port 62 is bounded, and overlapping inlet port 62, on the radial outer side of inlet port 62. Therefore, high pressure introducing groove 400 of this example, too, can introduce the outlet pressure almost over the entirety of the sliding region D as in the high pressure introducing groove 300 shown in FIG. 18.

Sixth Embodiment

Figure 28:
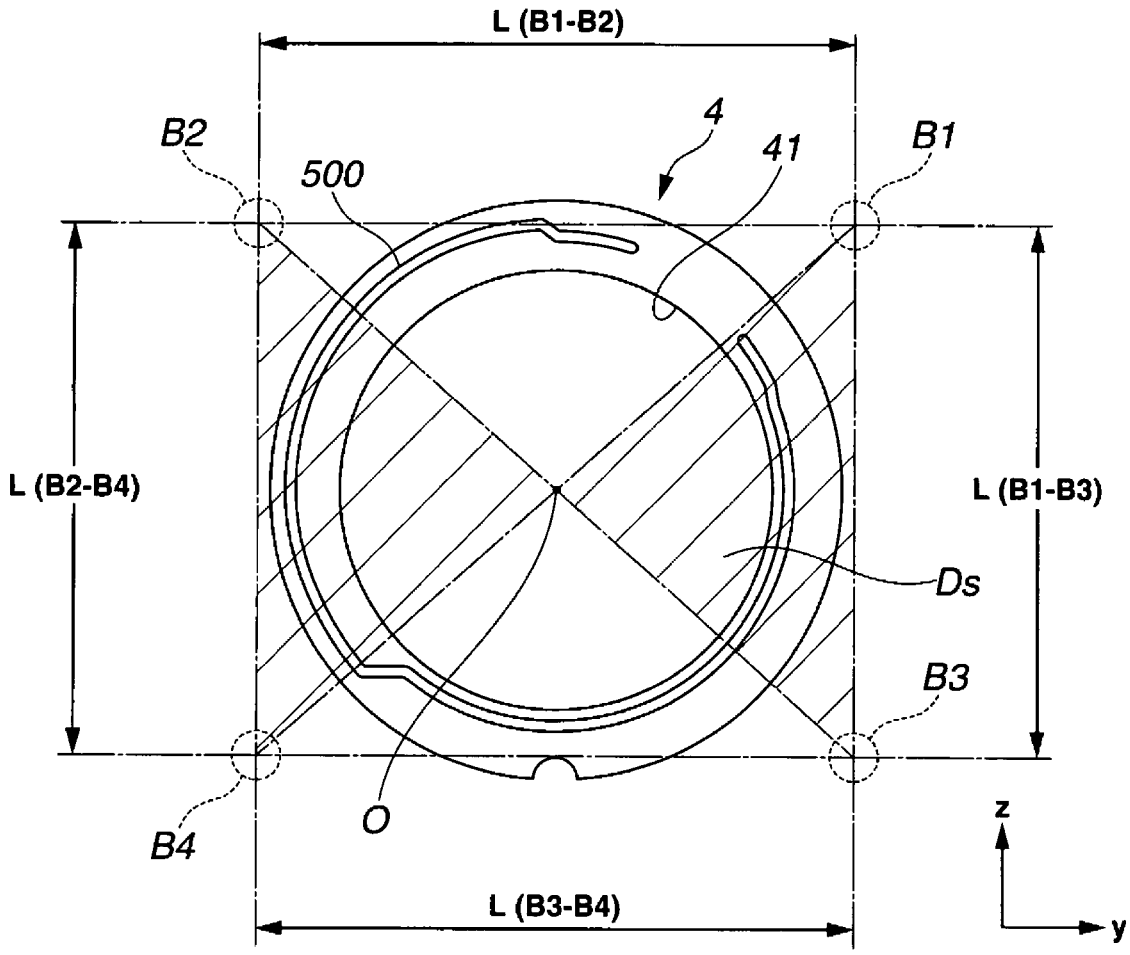
FIG. 28 is a view of a cam ring of the vane pump according to a sixth embodiment of the present invention, for showing the x-axis positive side of the cam ring.

FIG. 28 shows a variable displacement vane pump according to a sixth embodiment of the present invention. The basic construction is the same as that of the fourth embodiment. In the sixth embodiment, a high pressure introducing groove 500 is formed directly in cam ring 4 (in at lease one of the x-axis positive and negative sides of cam ring 4). In the sixth embodiment, high pressure introducing groove 500 is formed so as to extend around the center axis almost over the entirety of the 360° circumference, and so arranged that the outlet pressure is introduced into high pressure introducing groove 500. In this example, the angular distance from one end to the other end of high pressure introducing groove 500 along the arc-shaped groove 500 is greater than 270° and less than 360°.

This high pressure introducing groove 500 can introduce the outlet pressure always in the sliding contact surface between cam ring 4 and rear body 12 or in the sliding contact surface between cam ring 4 and pressure plate 6. Therefore, the high pressure introducing groove(s) 500 formed in cam ring 4 can uniformize the deformation in the sliding contact surfaces, and provide the same effects as in the fourth or fifth embodiment.

Variation of Sixth Embodiment

Figure 29:
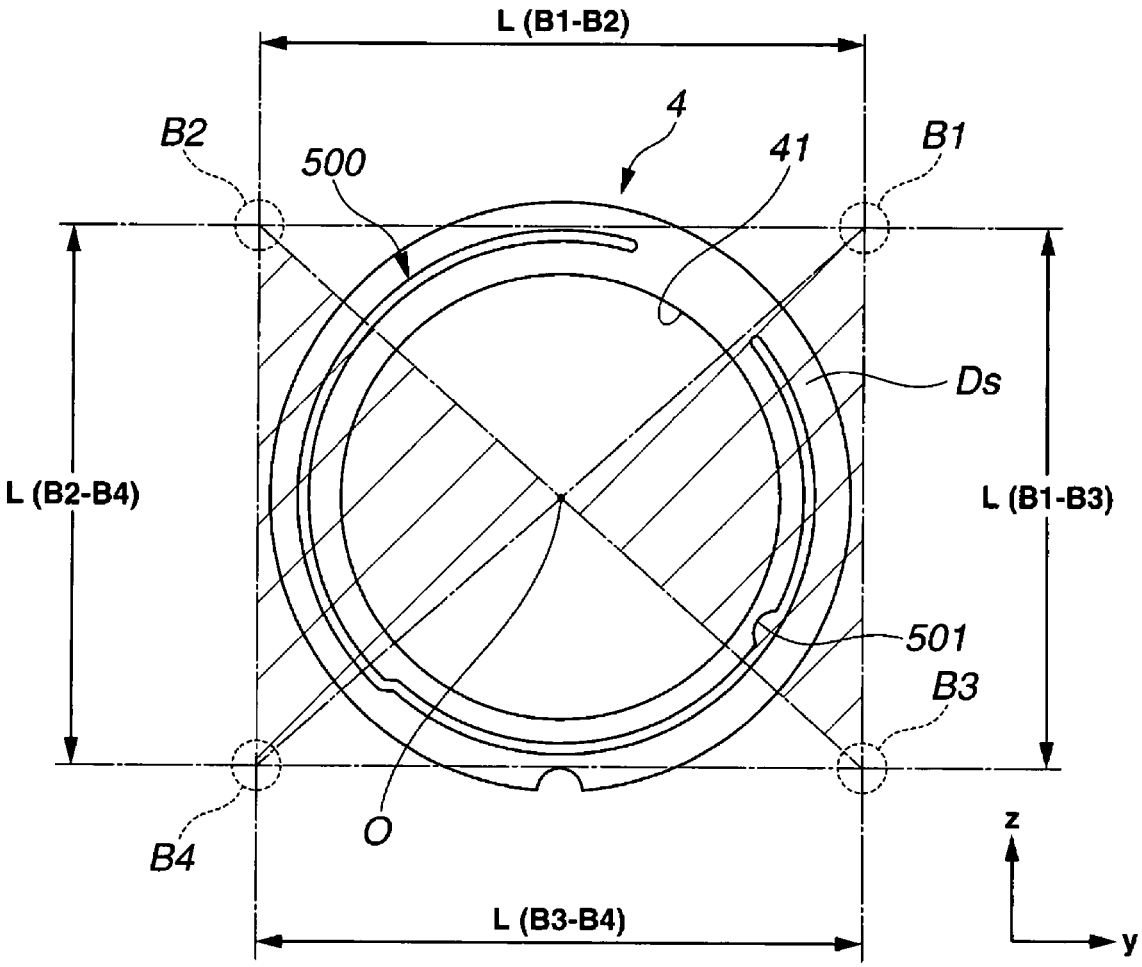
FIG. 29 is a view of the cam ring of the vane pump according to a variation 6-1, for showing the x-axis positive side of the cam ring.

FIG. 29 shows variation of the sixth embodiment in which the shape of the high pressure introducing groove 500 is different from that shown in FIG. 28. The high pressure introducing groove 500 of FIG. 29 includes a portion 501 for maintaining the communication with outlet port 122 during the sliding contact operation. This portion 501 projects radially inwards from a main arc groove segment.

The present invention is not limited to the illustrated examples. Various modifications and variations are further possible within the scope of the present invention. The back pressure chambers 33 at the radial inner ends of the radial slots 31 of rotor 3 may be arranged so that the outlet pressure Pout is supplied to the back pressure chambers 33. Alternatively, the back pressure chambers 33 may be arranged so that the inlet pressure Pin is supplied to the back pressure chambers 33. In the first through third embodiments, the first and second pressure introducing grooves 65, 124, 66 and 125 are formed in both of pressure plate 6 and rear body 12. However, the first and second grooves may be formed only in one of the pressure plate 6 and rear body 12.

According to a generic aspect of all the illustrated embodiments and variations shown in FIGS. 1~29, a variable displacement vane pump comprises: (i) a drive shaft rotating on a center axis of the vane pump; (ii) a rotor which is mounted on the drive shaft so that the rotor is driven by the drive shaft, which is formed with a plurality of radial slots opening in an outer circumference of the rotor and which is provided with a plurality of vanes each of which is slidably received in one of the slots; (iii) an annular cam ring receiving therein the rotor rotatably, the cam ring being arranged to swing in a first direction, about a swing axis which extends along the center axis and which is spaced from the center axis in a second direction, and to define a plurality of pumping chambers with the vanes between the rotor and the cam ring; and (iv) a pump casing encasing the cam ring and the rotor. The pump casing comprises (iv-a) a circumferential wall surrounding the cam ring, including an inside bore in which the cam ring is swingable on the swing axis, and defining first and second pressure chambers which are formed between the circumferential wall and the cam ring, and which are located, respectively, on first and second lateral sides opposing in the first direction across the center axis, so that a first fluid pressure in the first pressure chamber acts to force the cam ring to swing toward the second lateral side in the first direction, and a second fluid pressure in the second pressure chamber acts to force the cam ring to swing toward the first lateral side in the first direction; and (iv-b) first and second axial side walls disposed on both sides of the cam ring so that the cam ring is located axially between the first and second axial side walls. The pump casing further comprises an inlet port formed in at least one of the first and second side walls and arranged to let in an operating fluid into the pumping chambers; an outlet port formed in at least one of the first and second side walls and arranged to let out the operating fluid from the pumping chambers; and a pressure introduction groove formed in a sliding contact surface between the cam ring and one of the first and second side walls. The first direction may be a direction along a first imaginary axis (such as the y-axis) which is perpendicular to the center axis, and the second direction may be a direction along a second imaginary axis (such as the z-axis) perpendicular to the first imaginary axis (y-axis) and to the center axis of the drive shaft.

The above-mentioned variable displacement vane pump according to the general aspect may further have one or more of the following feature generic to all the illustrated embodiments and variations. The pressure introduction groove includes a groove segment, such as for example identified as element 320 in FIG. 18, which is formed on the radial outer side of the inlet port, which is separated from the inlet port by an intervening region, such as for example identified as element 501 in FIG. 18, of the sliding contact surface extending circumferentially between the inlet port and the groove segment of the pressure introduction groove. The groove segment of the pressure introduction groove may be curved like a circular arc and may extend circumferentially around the center axis, along the inlet port which may be also curved like a circular arc and may extend circumferentially around the center axis. The intervening region of the sliding contact surface may extend circumferentially around the center axis, between the groove segment and the inlet port.

In all the illustrated embodiments and variations, the outlet port is formed between the imaginary swing axis defined by pin 40 and the center axis defined by drive shaft 2. The inlet port is formed at a position diametrically opposite to the position of the outlet port. The inlet and outlet ports are curved like a circular arc, and separated from each other in the second direction along the second imaginary axis (z-axis) so that the inlet and outlet ports confront each other across drive shaft 2 in the second direction along the second imaginary axis (z-axis). The inlet and outlet ports are confined in an imaginary annular zone around the center axis. The sliding contact surface has an imaginary outlet side sector, an imaginary inlet side sector, an imaginary first lateral side sector and an imaginary second lateral side sectors. Each of the sectors is a sectorial region bounded by two radii and the included circular arc of a circle around the center axis. The outlet side sector is bounded by a radius passing through one circumferential end of the outlet port and a radius passing through the other circumferential end of the outlet port. The inlet side sector is bounded by a radius passing through one circumferential end of the inlet port and a radius passing through the other circumferential end of the inlet port. The outlet port is formed only in the outlet side sector, and the inlet port is formed only in the inlet side sector. The first lateral side sector is formed, on a first lateral side, circumferentially between the outlet side sector and inlet side sector so that the outlet side and inlet side sectors are separated circumferentially from each other by the first lateral side sector. The second lateral side sector is formed, on a second lateral side, between the outlet side and inlet side sectors so that the outlet side and inlet side sectors are separated circumferentially from each other on the second lateral side by the second lateral side sector. The pressure introduction groove may include an arc groove extending circumferentially along an imaginary larger circle surrounding the annular zone in which the inlet and outlet ports are confined, and having a first end portion formed in the outlet side sector, an intermediate portion extending through one of the first and second lateral side sectors, and a second end portion formed in the inlet side sector on the radial outer side of the inlet port, as shown at least in FIGS. 5, 6, 7, 8, 9, 10, 11, 12, 13, 14, 18, 19, 21, 27, 28 and 29. The sliding contact surface may be further formed with at least one back pressure introducing groove (130, 170) arranged to introduce the outlet pressure to a back pressure chamber (33) formed at a radial inner end of each radial slot (31) to urge the corresponding vane (32) radially outwards. The back pressure introducing groove (130, 170) is formed in a center zone surrounded by the annular zone.

In the illustrated embodiments and variations, the pump casing comprises first and second bodies (or body members) joined together by at least four bolts (B1~B4) arranged at four vertex points of an imaginary quadrilateral, such as a rectangle, having two first opposing sides confronting across the center axis and two second opposing sides confronting across the center axis. An average of the lengths of the first opposing sides (or the interaxis distances) is shorter than an average of the lengths of the second opposing side (the interaxis distances). The pressure introduction groove is formed in at least one of a first triangle defined by two radii and a first one of the two first opposing sides and a second triangle defined by two radii and a second one of the two first opposing sides (as shown by hatching in FIG. 5, for example). In the case of a rectangle centered at the center axis (O), the four bolts (B1~B4) are arranged at four vertex points of an imaginary rectangle having two parallel longer sides and two parallel shorter sides, and the pressure introduction groove is formed in at least one of a first triangle defined by two radii and a first one of the two parallel shorter sides and a second triangle defined by two radii and a second one of the two parallel shorter sides.

The vane pump may further comprise a spring (201) for urging the cam ring 4 to swing in the first direction (along the y-axis) toward the first pressure chamber A1, or toward the position at which the eccentricity of the cam ring is greatest.

The pump casing may further include a first connecting fluid passage (such as passages 52 and 113) connecting the first pressure chamber A1 with control valve 7 so that the control pressure is introduced into first pressure chamber A1.

The pump casing may further include a second connecting fluid passage (such as groove 123 shown in FIG. 18) supplying the inlet pressure into the second pressure chamber A2.

First pressure introduction grooves 65 and 124 are formed at the position for communicating with the first pressure chamber A1 so that the control pressure Pv is supplied into first pressure introduction grooves 65 and 124 whereas second pressure introduction grooves 66 and 125 are formed at the position for communicating with the second pressure chamber A2 so that the inlet pressure Pin is supplied into second pressure introduction grooves 66 and 125, in the first embodiment, second embodiment, and third embodiment. In the variation 1 shown in FIGS. 11 and 12, first pressure introduction grooves 65 and 124 are formed at the position for communicating with the first pressure chamber A1 so that the control pressure Pv is supplied into first pressure introduction grooves 65 and 124 as in the first, second and third embodiments, whereas second pressure introduction grooves 66 and 125 communicate with the outlet port so that the outlet pressure Pout is supplied into second pressure introduction grooves 66 and 125. In the variation 2 shown in FIGS. 13 and 14, first pressure introduction grooves 65 and 124 are connected with inlet ports 62 and 121 so that the inlet pressure Pin is supplied into first pressure introduction grooves 65 and 124, whereas second pressure introduction grooves 66 and 125 communicate with the second pressure chamber A2 so that the inlet pressure Pin is supplied into second pressure introduction grooves 66 and 125.

In the fourth embodiment shown in FIG. 18, variation 4-1 (FIG. 21), variation 4-2 (FIG. 22), and variation 4-3 (FIG. 23), the first and second pressure introduction grooves 310 and 320 are both connected with the outlet port 122. In the variations 4-2 and 4-3, there is further provided the third (lower) pressure introducing groove 330 or 330'. In the fifth embodiment shown in FIG. 24, variation 5-1 (FIG. 27), the first and second pressure introduction grooves 410 and 420 are both connected with the outlet port 63. In the sixth embodiment (FIG. 28), and variation 6-1 (FIG. 29), the high pressure introducing groove 500 is formed in cam ring 4 so that the outlet pressure is introduced into the groove 500.

This application is based on a first prior Japanese Patent Application No. 2006-311098 filed on Nov. 17, 2006, and a second prior Japanese Patent Application No. 2005-336452 filed on Nov. 22, 2005. The entire contents of these Japanese Patent Applications are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement vane pump comprising:

a drive shaft;

a rotor which is adapted to be driven by the drive shaft, which is formed with a plurality of slots and which is provided with a plurality of vanes each of which is slidably received in one of the slots;

an annular cam ring receiving therein the rotor rotatably, the cam ring being arranged to swing about a swing axis, and to define a plurality of pumping chambers with the vanes between the rotor and the cam ring;

a pressure control device; and a pump casing encasing the cam ring and the rotor, the pump casing including, first and second side walls disposed on both sides of the cam ring so that the cam ring is located axially between the first and second side walls, an inlet port formed in at least one of the first and second side walls, an outlet port formed in at least one of the first and second side walls, a circumferential wall surrounding the cam ring and defining first and second pressure chambers formed between the circumferential wall and the cam ring, one of the first and second pressure chambers being connected with the pressure control device so that a fluid pressure is controlled by the pressure control device, and a pressure introduction groove formed in a sliding contact surface between the cam ring and one of the first and second side walls, and arranged so that an intermediate pressure lower than an outlet pressure and higher than an inlet pressure is introduced into the pressure introduction groove.

2. The variable displacement pump as claimed in claim 1, wherein the inlet port is formed in a region in which a volume of each pumping chamber increases whereas the outlet port is formed in a region in which the volume of each pumping chamber decreases; wherein the first and second pressure chambers are arranged to control an eccentricity of the cam ring.

3. The variable displacement pump as claimed in claim 2, wherein the pressure introduction groove is arranged so that the pressure in one of the first and second pressure chambers is introduced into the pressure introduction groove.

4. The variable displacement pump as claimed in claim 3, wherein the pressure control device is arranged to receive the outlet pressure and the inlet pressure, and to produce a mixed pressure from the outlet pressure and the inlet pressure, and connected with a control pressure chamber which is one of the first and second pressure chambers so that the fluid pressure in the control pressure chamber is controlled by the pressure control device, and the pressure introduction groove is formed at a position for communication with the control pressure chamber and receiving the mixed pressure.

5. The variable displacement pump as claimed in claim 4, wherein the pump casing further includes a first connecting fluid passage to connect the pressure control device with the control pressure chamber which is one of the first and second fluid pressure chambers and a second connecting fluid passage to supply the inlet pressure to an inlet pressure chamber which is the other of the first and second fluid pressure chambers.

6. The variable displacement pump as claimed in claim 1, wherein the pressure introduction groove is formed in the sliding contact surface which is a side surface of one of the first and second side walls.

7. The variable displacement pump as claimed in claim 6, wherein the pressure introduction groove includes an arcuate groove formed on the radial outer side of the inlet port, and a branch groove branching off from the arcuate groove to the radial outer side of the arcuate groove, and communicating with the first pressure chamber.

8. The variable displacement pump as claimed in claim 7, wherein the branch groove extends from the arcuate groove to a groove end formed with a fluid accumulating portion.

9. The variable displacement pump as claimed in claim 1, wherein the pressure introduction groove is formed on a radial outer side of the inlet port.

10. The variable displacement pump as claimed in claim 1, wherein the pump casing comprises a member including one of the first and second side walls, and the pressure introduction groove is formed in the member simultaneously at the time of forming the member.

11. The variable displacement pump as claimed in claim 1, wherein the pressure introduction groove is in the form of a circular arc conforming to the shape of the cam ring.

12. The variable displacement pump as claimed in claim 11, wherein the pressure introduction groove is in the form of the circular arc conforming to the shape of the cam ring in a state in which an eccentricity is greatest.

13. The variable displacement pump as claimed in claim 1, wherein the pump casing further comprises a high pressure introducing groove formed on a radial outer side of the outlet port and arranged so that an outlet pressure is introduced.

14. The variable displacement pump as claimed in claim 13, wherein the high pressure introduction groove is connected with the outlet port.

15. The variable displacement pump as claimed in claim 1, wherein the cam ring is arranged to swing about a pin supported at a position on a radial outer side of the outlet port by the first and second walls.

16. The variable displacement pump as claimed in claim 1, wherein the pressure introduction groove is arranged to receive a control fluid pressure produced by the pressure control device, and the pressure control device is arranged to vary the control fluid pressure between the outlet pressure and the inlet pressure.

17. A variable displacement vane pump comprising:

a pump body;

a drive shaft supported rotatably in the pump body;

a rotor which is mounted on the drive shaft in the pump body, which is adapted to be driven by the drive shaft, which is formed with a plurality of slots and which is provided with a plurality of vanes each of which is slidably received in one of the slots;

an annular cam ring receiving therein the rotor rotatably, the cam ring being arranged to swing about a swing axis in the pump body, and to define a plurality of pumping chambers with the vanes between the rotor and the cam ring;

first and second plate members disposed on both sides of the cam ring so that the cam ring is located axially between the first and second plate members;

an inlet port formed in at least one of the first and second plate members in a region in which the volume of each pumping chamber increases;

an outlet port formed in at least one of the first and second side walls in a region in which the volume of each pumping chamber decreases, first and second pressure chambers formed around the cam ring, and arranged to control an eccentricity of the cam ring, a pressure control device to control a fluid pressure introduced into one of the first and second pressure chambers; and a pressure introduction groove formed in a sliding contact surface between the cam ring and one of the first and second plate members, on the side of the inlet port, the pressure introduction groove being separated from the inlet port, and including a groove segment which is formed on the radial outer side of the inlet port, which is separated from the inlet port by an intervening region of the sliding contact surface extending circumferentially between the inlet port and the groove segment of the pressure introduction groove.

18. The variable displacement pump as claimed in claim 17, wherein the pressure introduction groove is arranged so that a fluid pressure lower than an outlet pressure of the pump is introduced into the pressure introduction groove.

* * * * *